US005286916A

United States Patent [19]

Yamauchi

[11] Patent Number: 5,286,916

[45] Date of Patent: Feb. 15, 1994

[54] MUSICAL TONE SIGNAL SYNTHESIZING APPARATUS EMPLOYING SELECTIVE EXCITATION OF CLOSED LOOP

[75] Inventor: Akira Yamauchi, Hamamatsu, Japan

[73] Assignee: Yamaha Corporation, Hamamatsu, Japan

[21] Appl. No.: 820,573

[22] Filed: Jan. 14, 1992

[30] Foreign Application Priority Data

Jan. 16, 1991 [JP] Japan ..... 3-015845

[51] Int. Cl.[5] ..... G10H 1/057; G10H 1/12

[52] U.S. Cl. ..... 84/661; 84/663; 84/DIG. 10

[58] Field of Search ..... 84/723-742, 84/659-661, 663, DIG. 10

[56] References Cited

U.S. PATENT DOCUMENTS 4,785,706 11/1988 Toshifumi ..... 84/DIG. 10
4,815,354 3/1989 Kunimoto ..... 84/DIG. 10
4,852,444 8/1989 Hoover et al. ..... 84/DIG. 10
4,879,937 11/1989 Hirano ..... 84/DIG. 10
4,907,483 3/1990 Rose et al. ..... 84/DIG. 10
5,182,415 1/1993 Kunimoto ..... 84/DIG. 10

FOREIGN PATENT DOCUMENTS 0248527 4/1987 European Pat. Off. .

*Primary Examiner*—Stanley J. Witkowski
*Attorney, Agent, or Firm*—Graham & James

[57] ABSTRACT

Tone generation in conformity with the tone generating mechanism of actual rubbed string instruments is made to obtain musical tones rich in reality as generated by natural musical instruments. Performance information outputted from a performance manipulator is converted into tone generation parameter by parameter generating means. Excitation means generate an excitation signal corresponding to the string-rubbing style on the basis of the tone generation parameter. A loop circuit gives both acoustic and propagation delay of the string to the excitation signal to thereby generate musical tone signals.

29 Claims, 23 Drawing Sheets

FIG. 8

| OCTAVE / PITCH NAMES | 1 | 2 | 3 | 4 | 5 | 6 | 7 |
|---|---|---|---|---|---|---|---|
| C | $24 | $30 | $3C | $48 | $54 | $60 | $6C |
| C # | $25 | $31 | $3D | $49 | $55 | $61 | $6D |
| D | $26 | $32 | $3E | $4A | $56 | $62 | $6E |
| D # | $27 | $33 | $3F | $4B | $57 | $63 | $6F |
| E | $28 | $34 | $40 | $4C | $58 | $64 | $70 |
| F | $29 | $35 | $41 | $4D | $59 | $65 | $71 |
| F # | $2A | $36 | $42 | $4E | $5A | $66 | $72 |
| G | $2B | $37 | $43 | $4F | $5B | $67 | $73 |
| G # | $2C | $38 | $44 | $50 | $5C | $68 | $74 |
| A | $2D | $39 | $45 | $51 | $5D | $69 | $75 |
| A # | $2E | $3A | $46 | $52 | $5E | $6A | $76 |
| B | $2F | $3B | $47 | $53 | $5F | $6B | $77 |

MUSICAL TONE SIGNAL SYNTHESIZING APPARATUS EMPLOYING SELECTIVE EXCITATION OF CLOSED LOOP

BACKGROUND OF THE INVENTION

1 Field of the Invention

The present invention relates to an electronic musical instrument for synthesizing musical tones of a rubbed string instrument such as a violin or the like.

2 Description of the Related Art

As well known, an electronic musical instrument for synthesizing musical tones of a rubbed string instrument such as a violin or the like uses an FM tone color synthesis type tone generator, a PCM waveform storage type tone generator, or the like.

According to the FM tone color synthesis type tone generator, a characteristic feature as to the tone color of a rubbed string instrument can be provided. With respect to variation or richness of tone color, however, the tone color is considerably different from the tone color of the natural musical instrument. On the other hand, the PCM waveform storage type tone generator can generate a waveform more perfectly approaching the waveform of the natural musical instrument, so that considerably rich tone color can be formed. In the waveform storage type tone generator, however, it is difficult to generate an output waveform widely different from the stored original waveform, even when interpolation is made by using various types of stored waveforms. That is, the tone color is poor in variation. Further, there arises a problem in output waveform continuity. For example, there is indicated a problem that switching noise is generated.

As described above, the conventional digital tone generators have a problem that musical tones having a rich reality as the musical tones of natural musical instruments can hardly be generated because the same tone color is formed whenever a tone is generated.

SUMMARY OF THE INVENTION

Upon such circumstances, the present invention has as its object provision of an electronic musical instrument for faithfully simulating the tone generating mechanism of a rubbed string instrument.

According to an aspect of the present invention, there is provided an electronic musical instrument comprising a manipulator for generating performance information corresponding to the manipulation performance, a parameter generating means for converting the performance information into tone generation parameters expressing the string-rubbing operations, an excitation means for generating an excitation signal equivalent to said vibration on the basis of the tone generation parameters, and a tone generator having a loop circuit providing acoustic loss and propagation delay of a string through circulating the excitation signal.

According to the aforementioned configuration, performance information outputted from the manilpulator is converted into tone generation parameters by the parameter generating means. The excitation means generates an excitation signal corresponding to the string-rubbing state on the basis of the tone generation parameters. The loop circuit gives acoustic loss and propagation delay of a string to the excitation signal to generate a tone signal. Accordingly, tones are generated by a tone generating mechanism approaching the mechanism of a rubbed string instrument. Musical tones and realistic as rich as the tones of natural musical instruments can be generated.

BRIEF DESCRIPTION OF THE DRAWINGS

FIG. 8 is a table for explaining MIDI key code in this embodiment;

DESCRIPTION OF THE PREFERRED EMBODIMENTS

Embodiments of the present invention will be described hereunder with reference to the drawings.

A. Outline

Figure 1:
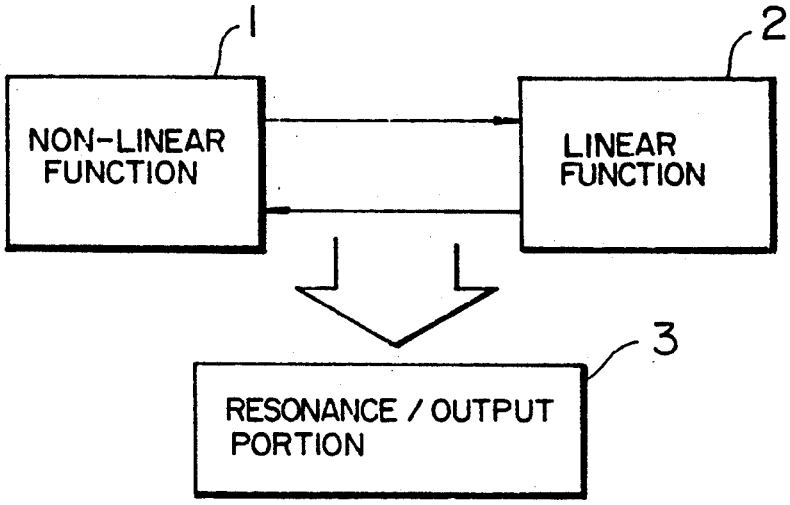
FIG. 1 is a block diagram showing the outline of an embodiment of the present invention.

FIG. 1 is a block diagram showing the outline of a first embodiment of the present invention. An electronic musical instrument shown in FIG. 1 is provided to simulate a rubbed string instrument such as a violin. In FIG. 1, the reference numeral 1 designates a nonlinear function for simulating the operational characteristics of a bow and a string. The reference numeral 2 designates a linear function for simulating the propagation characteristics of a string rubbed by a bow. The reference numeral 3 designates a resonance/output portion for simulating the resonance of string vibration.

Figure 2:
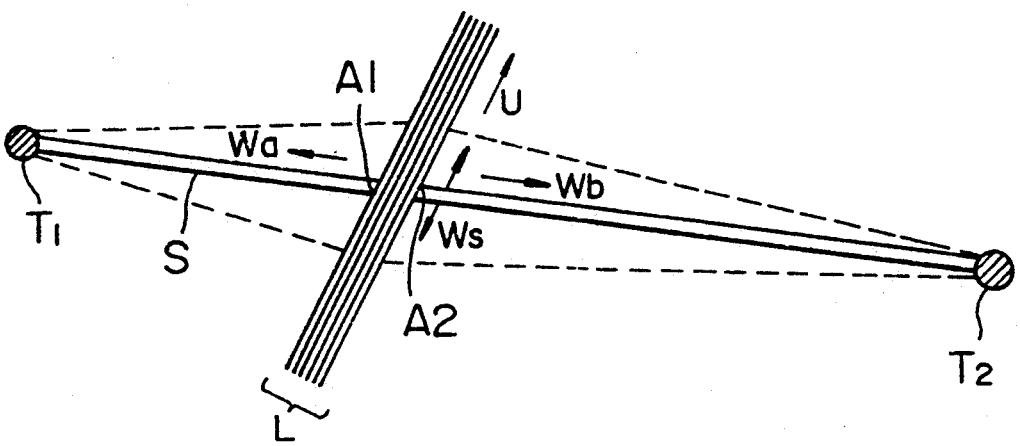
FIG. 2 is a schematic diagram for explaining a string rubbing mechanism in this embodiment.

Before description of specific configurations of the aforementioned elements, a mechanism operating when excitation vibration is introduced into a string of the violin as a typical rubbed string instrument will be described hereinbelow with reference to FIG. 2. In FIG. 2, S represents a string of the violin and L represents a bow having hairs. Fixed ends $T_1$ and $T_2$ for fixing both ends of the string S are equivalent to a nut and a bridge of the violin, respectively. When the bow L is moved (in the direction of the arrow U) while pressed against the string S, the string S moves in response to the movement of the bow L in a period in which static friction force between the bow L and the string S acts. When the displacement of the string S becomes so large that force determined by elastic force of the string S exceeds the static friction force, the string S slips against the bow L so as to go back to the original position. As a result, vibration of the string S is excited by the bow L. Because the bow L is actually constituted by a bundle of hairs, the vibration is excited in each friction position in which the string S touches each hair. In FIG. 2, $A_1$ represents a string-rubbing position of the string S which is nearest to the fixed end $T_1$, and $A_2$ represents a string-rubbing position of the string S which is nearest to the fixed end $T_2$.

The vibration excited in each string-rubbing position by the string S is distributed into two. That is, one propagates as a vibration wave Wa toward the fixed end $T_1$ and the other propagates as a vibration wave Wb toward the fixed end $T_2$. The vibration wave Wa is reflected after phase inversion in the fixed end $T_1$. Then, the reflection wave propagates toward the fixed end $T_2$. On the other hand, the vibration wave Wb is reflected after phase inversion in the fixed end $T_2$. Then, the reflection wave propagates toward the fixed end $T_1$. As a result, the string S vibrates according to a stationary wave Ws obtained by adding the vibration waves Wa and Wb and having the fixed ends $T_1$ and $T_2$ as nodes.

The configuration shown in FIG. 1 simulates a tone generating process comprising the steps of: producing vibration nonlinear to the movement of the bow on the string on the basis of friction force produced by rubbing the string with the bow; transmitting the once produced vibration to the string linearly; propagating the vibration of the string from the string-fixing bridge to the body of the musical instrument; and making the vibration resonate. Because the process contains a nonlinear function, the configuration is called "nonlinear tone synthesizing method".

Figure 3:
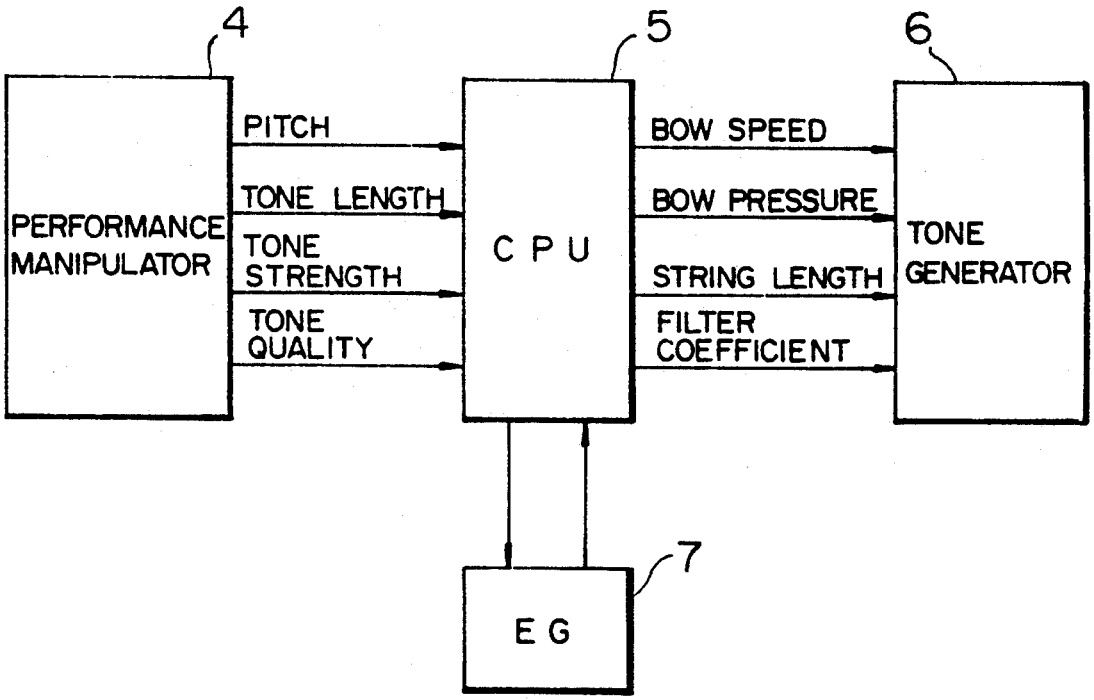
FIG. 3 is a block diagram showing the configuration of a first embodiment of the present invention.

FIG. 3 is a block diagram showing the outline of an electronic musical instrument using the aforementioned nonlinear tone synthesizing method. A performance manipulator 4 generates various kinds of information according to the performance manipulation. The various kinds of information contains pitch information, tone length information, tone strength information, tone quality, etc. A CPU 5 generates tone generation parameters on the basis of the various kinds of information supplied from the performance manipulator 4. The tone generation parameters contain a bow speed, a bow pressure, a string length, a filter coefficient, etc. A tone generator 6 uses the aforementioned nonlinear tone synthesizing method and generates musical tones according to a predetermined algorithm on the basis of the tone generation parameters supplied from the CPU 5. The configuration of the tone generator 6 will be described later. An envelope generator 7 controls the amplitude envelope of a musical tone on the basis of the ON/OFF of a key. According to this configuration, various kinds of information is supplied to the CPU 5 when the performance manipulator 4 is operated by a performer. The CPU uses the envelope generator 7, if necessary, to generate tone generation parameters and supply the parameters to the tone generator 6. The tone generator 6 generates a musical tone by simulating the tone generating mechanism of the rubbed string instrument.

Figure 4:
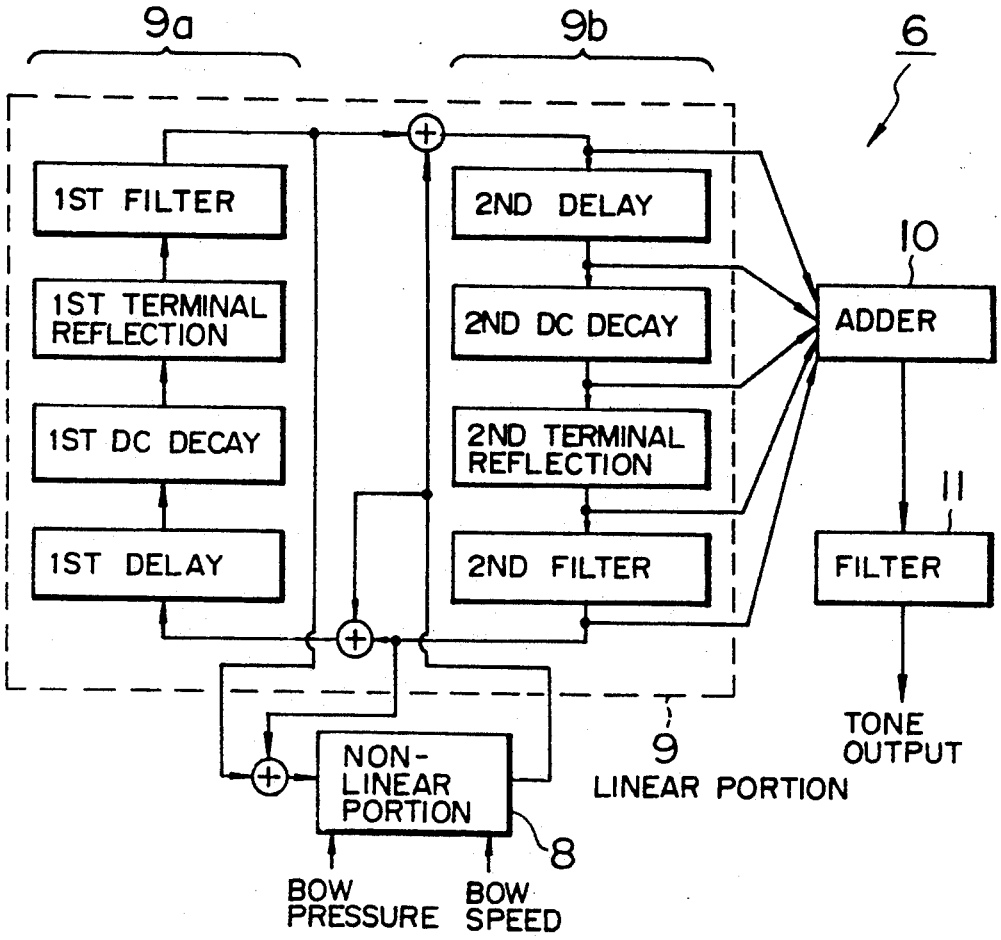
FIG. 4 is a block diagram showing the configuration of the tone generator 6 in this embodiment.

FIG. 4 is a block diagram showing an example of the configuration of the tone generator 6. A nonlinear portion 8 is a portion described by a function expressing friction characteristics between the bow and the string in the aforementioned string-rubbing positions. Both the bow speed and the bow pressure are supplied from the CPU 5 to the nonlinear portion 8. The reference numeral 9 designates a linear portion for simulating the mechanism by modeling the propagation characteristics of the string vibration as a concentrated constant. The linear portion 9 comprises a concentrated constant circuit 9a for expressing various kinds of characteristics of the string between the string-rubbing point and the bridge-side fixed end so as to be collected for the respective characteristics, and a concentrated constant circuit 9b being the same as the concentrated constant circuit 9a and for expressing the characteristics of the string between the string-rubbing point and the nut-side fixed end. It may be considered that these concentrated constant circuits 9a and 9b are circuits for concentrating the characteristics of the string into the bridge-side and nut-side fixed ends. Each of the concentrated constant circuits 9a and 9b includes a delay circuit for expressing the propagation delay of the string vibration, a low-pass filter circuit for expressing phase characteristics of the string vibration, a terminal reflection circuit for expressing phase inversion in the fixed end, and an AC decay circuit for expressing amplitude-passing characteristic. The amplitude-passing characteristic is determined by the mass of the string, the sectional area thereof, the tension thereof, etc. An adder circuit 10 adds outputs of partial circuits which constitute the concentrated constant circuit 9b. The adder circuit 10 is based on the following reason. In the viewpoint of propagation of wave from the bridge to the instrument body, it may be better to pick up the string vibration from a tone output pickup point near to the bridge. Because the linear portion 9 is however expressed as a concentrated constant, it is not always best to consider the bridge as an output point. Accordingly, it is better to output a synthetic signal obtained by adding output signals in respective points. The reference numeral 11 designates a high-pass filter circuit for controlling the amplitude-passing characteristic for the output of the adder circuit 10 to adjust the tone color.

Figure 5:
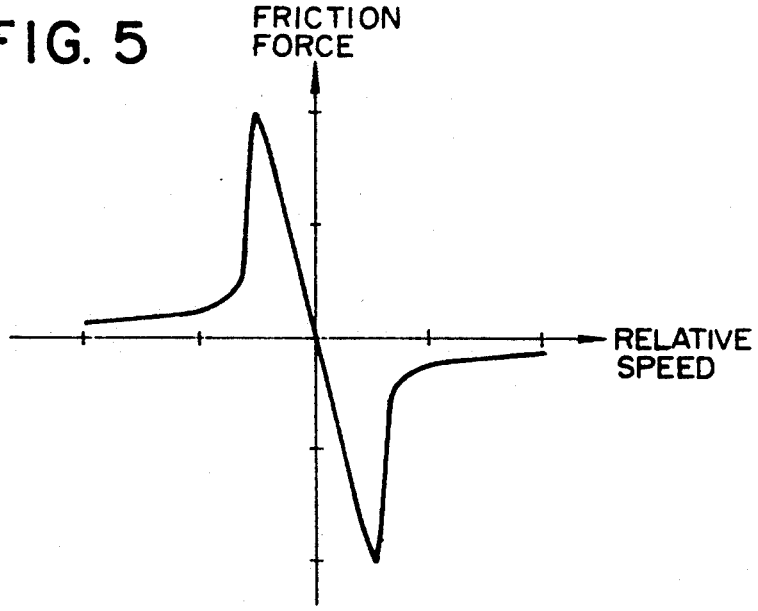
FIG. 5 is a graph showing the friction characteristic between a bow and a string in the nonlinear portion 8.

FIG. 5 is a graph showing a nonlinear function in the nonlinear portion 8, that is, the friction characteristic between the bow and the string. In the graph, the abscissa represents the relative speed between the bow speed and the transverse speed of string vibration, and the ordinate represents the friction force with respect to the relative speed. The ordinate may be considered as the impulse with respect to the string vibration. Because the maximum of the ordinate is maximum static friction force, the scale of the graph is changed analogously on the basis of the bow pressure. In the case where tone quality is to be changed on the basis of the tone strength, the scale of the graph is changed non-analogously. The aforementioned nonlinear function is stored as a table in an ROM of the nonlinear portion 8.

The relationship between the tone generator 6 having the aforementioned configuration and the tone generation parameters (see FIG. 3) supplied thereto will be described hereunder. As described above, the tone generation parameters "bow speed" and "bow pressure" act on the nonlinear table for attaining the characteristic shown in FIG. 5. The tone generation parameter "string length" decides the number of stages in the shift register constituting the delay circuit of the linear portion 9, to thereby determine the delay period. The tone generation parameter "filter coefficient" determines the characteristics (such as cutoff frequency, etc.) of the filter circuits of the linear portion 9 and the filter circuit 11.

Although the performance information generated in response to the performance manipulation includes pitch information, tone length information, tone strength information, and tone quality information, these kinds of information cannot have one-to-one correspondence to the tone generation parameters. Therefore, the CPU 5 converts these kinds of performance information into tone generation parameters. The CPU 5 operates a mechanism (hereinafter called "string-rubbing model") obtained by modeling the tone generating mechanism of a natural rubbed-string instrument. For example, the "string length" L is calculated by dividing the frequency f of performance information "pitch" by sampling the frequency fs and then subtracting therefrom the variable d determined by the characteristic of the filter circuit.

$$L=f/fs-d \quad \text{(Eq1)}$$

With respect to the "bow speed" Vb and the "bow pressure" Fb, a standard value of the ratio therebetween is first determined (as Vb/Fb=a). When the tone strength v is supplied from the performance manipulator 4 and when the bow pressusre Fb is replaced by the following equation $$Fb=v \quad \text{(Eq2)},$$

the bow speed Vb is calculated on the basis of the following equation because the value of ratio of Vb to Fb is determined as a.

$$Vb=a\times Fb \quad \text{(Eq3)}$$

In the string-rubbing model, the tone hardness or tone quality can be controlled by controlling the value of ratio a of Vb to Fb on the basis of the tone quality information supplied from the performance manipulator 4, because the tone quality is determined by the rate a. Although the control of tone quality on the basis of the change of the rate a is however limited, tone quality can be more widely changed by changing "filter coefficient". In the case where the manipulator is a keyboard, the tone length as performance information may be set so as to correspond to the time length of key depression. In this case, conversion on the basis of the equations Eq2 and Eq3 is made with the key-on. To approach the actual performance style more perfectly, the tone length v is multiplied by a time function. Although above description has been made upon the case where tone control is made to simulate the natural rubbed string instrument, it is a matter of course that a novel musical instrument can be created by providing unique control in utter disregard of the natural behavior of the rubbed string instrument.

For real-time performance of the electronic musical instrument using the nonlinear tone synthesizing method, for example, the tone generator 6 may be constituted by a DSP (digital signal processor).

Figure 6:
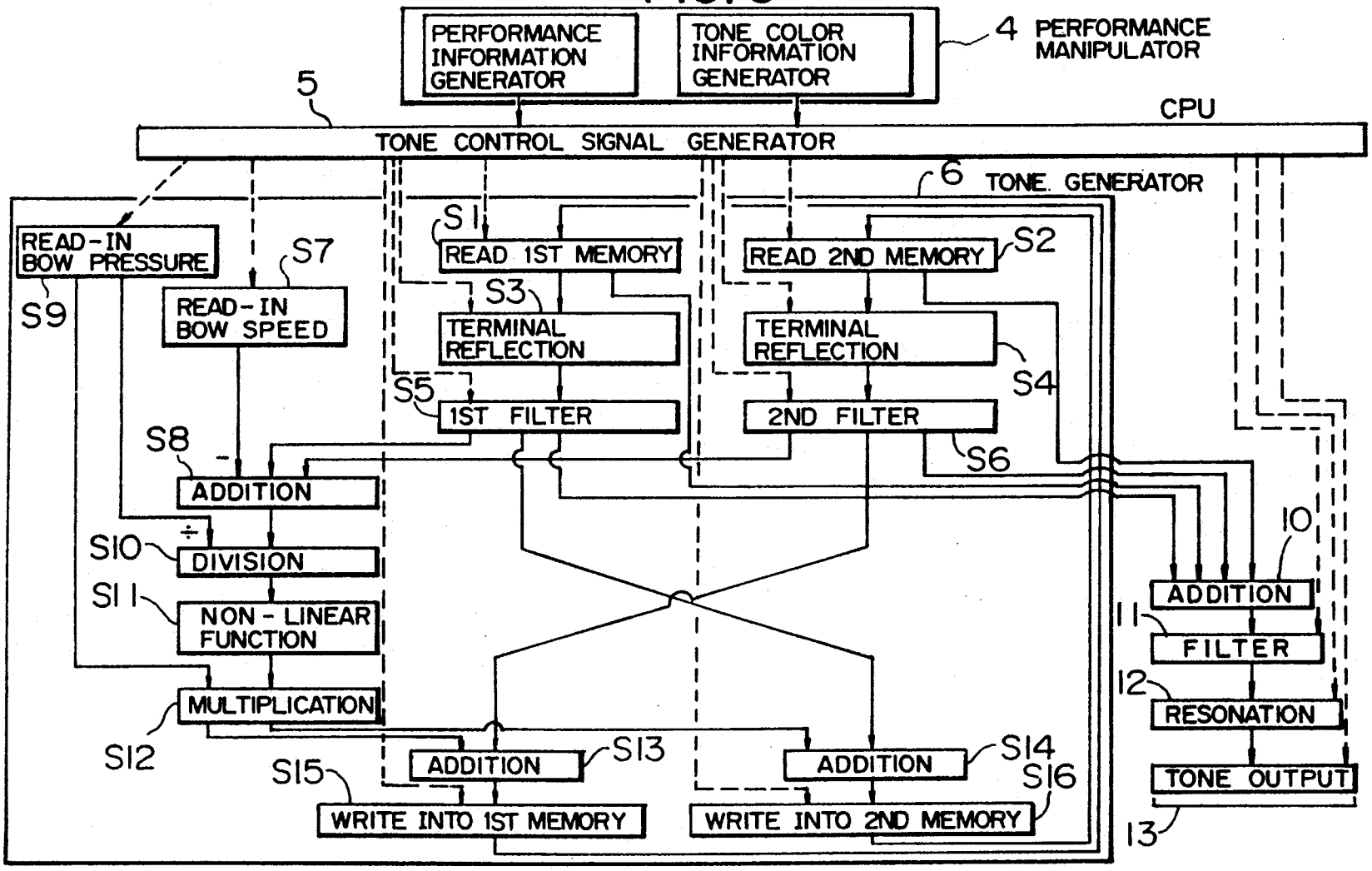
FIG. 6 is a schematic diagram for explaining the operation of a DSP constituting the tone generator 6.

FIG. 6 shows an example of the program flow in the case where the tone generator 6 is constituted by a DSP. The program flow will be described hereunder with reference to FIG. 6. In a step S1, an instantaneous speed of bow vibration at a string-rubbing point is provided by reading a first memory. The string vibration propagates on the bridge-side string. In a step S2, an instantaneous speed of bow vibration at a string-rubbing point is provided by reading a second memory. The string vibration propagates on the nut-side string. These data thus read are respectively supplied to steps S3 and S4 "terminal reflection" in which conditions for terminal reflection of the string are described. Then, data passing through the steps S3 and S4 are respectively supplied to the steps S5 and S6 in which propagation characteristics of the string are described. In step S8, the outputs from the steps S5 and S6 are added to or subtracted from the bow speed data read in a step S7.

Then, the bow pressure data read in a step S9 is divided by the output from the step S8 (a step S10). The result of the division is supplied to the next step S11. In the step S11, the value of the nonlinear table is read from the ROM having a nonlinear function, by using the result of the division as an address. Then, in a step S12, the bow pressure data is multiplied by the nonlinear function output value. The result of the multiplication is added to both the output from the step S5 and the output from the step S6 (steps S13 and S14). Then, the results of the additions are respectively written in first and second memories (steps S15 and S16). The term "first memory" means a shift register or memory for temporarily storing the speed of string vibration in the bridge side. The term "second memory" means a shift register or memory for temporarily storing the speed of string vibration in the nut side.

Various techniques may be considered as a method of picking up a musical tone from the aforementioned process. In general, a part of the bridge-side data is picked up from the "first filter" in the step S5 and supplied to the resonance system 12 to form a musical tone output through the output portion 13. The resonance system 12 simulates resonance in the body of the musical instrument and, for example, is constituted by a high-degree FIR filter. More rich acoustic effects can be provided by feeding the output from the resonance system 12 back to the first or second memory.

B. Embodiments using Various Kinds of Performance Manipulators

String-rubbing models in which various kinds of performance manipulators are applied to the electronic musical instrument using the nonlinear tone synthesizing method will be described hereunder. Examples of the performance manipulators used are a keyboard, a foot controller, a joy stick, a foot switch, a slide variable resistor, a portamento bar, a pressure sensor, etc.

B-1 String-Rubbing Model using Keyboard

String-rubbing models for designating the pitch, the tone length, the tone strength and the tone quality in accordance with the manipulation of a keyboard will be described hereunder.

B-1a Pitch Designation

Figure 7:
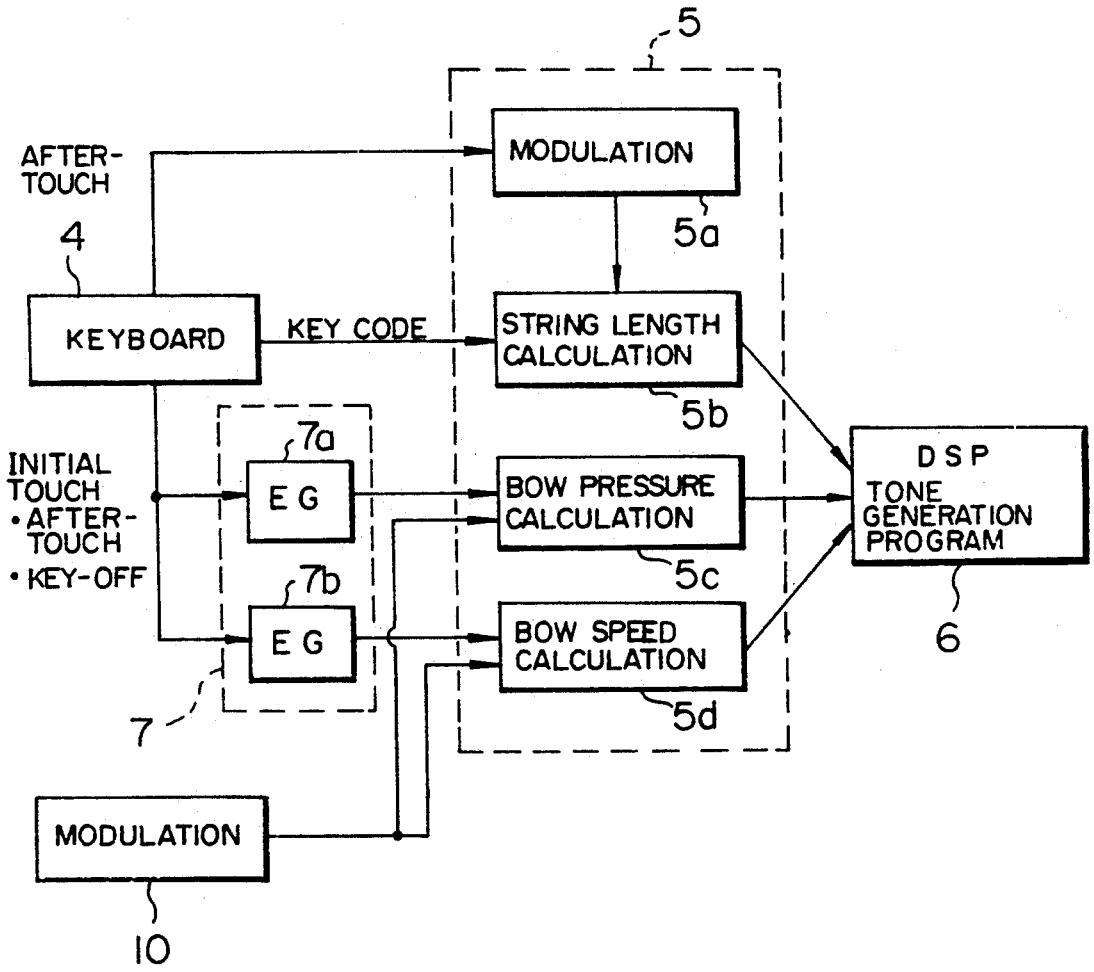
FIG. 7 is a block diagram showing another embodiment of the present invention.

FIG. 7 is a block diagram showing the configuration of another embodiment of the present invention. In each of FIGS. 7 and 3, like numerals refer to like parts. FIG. 7 is a different from FIG. 3 in that a modulation 10 is additionally provided. In FIG. 7, the reference numeral 4 designates an MIDI keyboard for providing MIDI information corresponding to the key depressing operation. MIDI key codes generated from the MIDI keyboard 4 are shown in FIG. 8. Key-on and key-off as most significant data among data generated from the MIDI keyboard will be described. First, key-on in the MIDI format is expressed by "$9? cc ii". Here, "cc" and "ii" represent hexadecimal digits respectively expressing the key code and the initial touch/key-on velocity. "?" represents a hexadecimal digit of from 0 to $F for expressing an MIDI channel. On the other hand, key-off is expressed by "$8? cc oo". Here, "oo" expresses the key velocity. Other key codes "SD? aa" and "$A? cc aa" are used as outputs for expressing the pressure of key depression after the key-on. The dey code "$D? aa" shows the case where all the keys of the keyboard are considered to be pressed by the same pressure. The key code "$A? cc aa" expresses the pressure of a key designated by "cc".

In FIG. 7, the reference numeral 5 designates a CPU. The CPU 5 comprises a modulation portion **5*a*, a string length calculation portion 5*b*, a bow pressure calculation portion 5*c* and a bow speed calculation portion 5*d*. The operations of the processing portions 5*a* to 5*d*** will be described later.

The pitch designating operation and the vibrato operation in the aforementioned configuration will be described hereunder.

Pitch designating Operation

The pitch is designated by controlling the string length in accordance with the key code. That is, in the case where the key codes generated in accordance with the key depressing operation have such correspondence as shown in FIG. 8, and when a key of C3 is operated, a corresponding key code "$3C" is outputted. Assuming now that perfect temperament is used, then "C3=261.6 Hz" is obtained in the case of the tuning of "A3=440 Hz". Accordingly, the relation between the key code KC and the frequency f is expressed by the following equation Eq4 because the key code of A3 is "$45".

$$f=fA3\times 2 \qquad \text{(Eq4)}$$

In the equation Eq4, fA3 represents the tone generation frequency at "a3". In the aforementioned case, fA3 is 440 Hz.

Assuming now that the respective numbers of stages in the shift registers of the delay circuits 1 and 2 in the tone generator 6 shown in FIG. 4 are represented by dly1 and dly2 and that the respective numbers of effective delay stages in the first and second filters are represented by L(flt1) and L(flt2), then the tone generation frequency f can be expressed by the following equation Eq5 when the tone generator 6 is operated in the sampling frequency fs.

$$f=fs/\{dly1+dly2+L(flt1)+L(flt2)\} \qquad \text{(Eq5)}$$

In the equation Eq5, L(flt1) and L(flt2) are values determined by the delay characteristics of the first and second filters. Accordingly, it is better to use dly1 and dly2 in the case of string length control. The ratio of dly1 to dly2, however, has a large influence on tone color. For example, though a softer tone less in harmonic components can be provided as the value of this ratio approaches 1, a sharp tone more in harmonic components can be provided as one becomes considerably larger than the other. Therefore, in the case where pitch control is to be provided without changing tone color, it is preferable that the sum is controlled with keeping the ratio constant. When the sum is represented by LENG, the sum is expressed by the following equation.

$$LENG=dly1+dly2 \qquad \text{(Eq6)}$$

When the aforementioned ratio is expressed in the form of the ratio of dly1 to LENG $$BPOS = dly1/LENG \quad \text{(Eq7)},$$

LENG and BPOS can be respectively classified as a pitch control parameter and a tone color control parameter. In this case, the relation between dly2 and BPOS is expressed by the following equation.

$$1 - BPOS = dly2/LENG \quad \text{(Eq8)}$$

The equation Eq5 is modified as follows.

$$LENG = fs/f - (L(flt1) + L(flt2)) \quad \text{(Eq9)}$$

It is apparent from the equation Eq9 that the value of LENG can be determined on the basis of the equation Eq9 when a key is pressed down to designate the tone generation frequency f on the basis of the equation Eq4. The problem herein is in a method for determining the value of L(flt1)+L(flt2). Because this value is expressed by a function of frequency, this value can be calculated if the phase characteristic is obtained on the basis of the transmission functions of the first and second filters. Alternatively, delay factors of the first and second filters can be stored in a memory in the form of a table of key codes corresponding to the delay factors.

Figure 9:
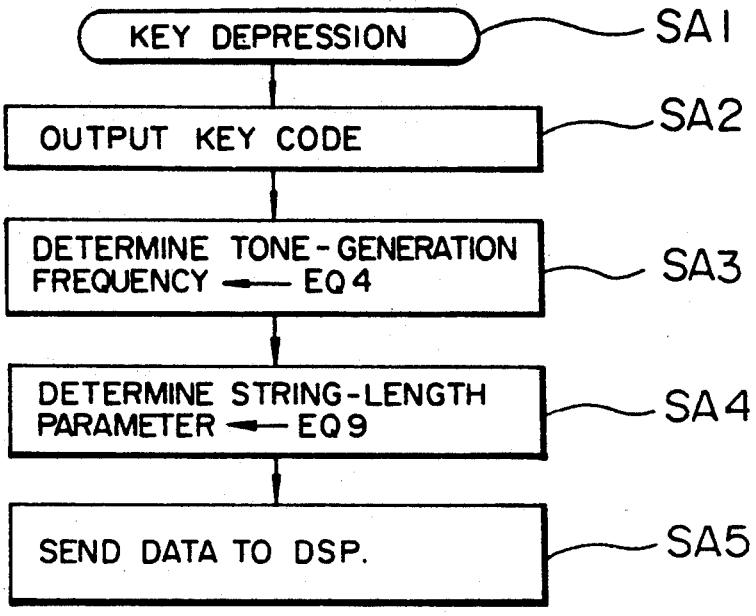
FIG. 9 is a flow chart for explaining the operation in the case where string length control is provided in accordance with the keyboard manipulation.

As described above, for designating pitch through the keyboard 4, string length control is made as shown in FIG. 9. That is, when a key depressing operation (a step SA1) is made, a key code corresponding to the depressed key is outputted (a step SA2) to determine the tone generation frequency f on the basis of the key code and the equation Eq4. Then, the string length LENG is obtained on the basis of the equation Eq9 (a step SA4) and supplied to the tone generator 6 to generate a desired pitch (a step SA5).

Case where Vibrato Operation is provided by using After-Touch (1)

The case where vibrato control is given to a generated tone by after-touch data generated in accordance with the pressure after key depression will be described hereunder. As described above, the after-touch data is expressed by two hexadecimal digits such as "aa". Because the most significant bit is not used actually, the after-touch data is a signal of 7 bits capable of expressing 128 stages. Vibrato control is given to the generated tone by changing the string length LENG in accordance with the after-touch data. For example, the vibrato operation is controlled by controlling the pressure to be given to the keyboard in a predetermined period in the same manner as in the actual performance of the violin. The after-touch output changes in a range of 128 stages of from 0 to 127 in accordance with the strength of the key depression. The string length LENG is modulated by the after-touch output on the basis of the following equation Eq10.

$$LENG = LENG0 \times (1 + aa \times coe1) \quad \text{(Eq10)}$$

In this equation Eq10, LENG0 represents the string length before modulation and is determined in accordance with the key code of the depressed key. In the equation Eq10, "aa" represents an after-touch data in a range of from 0 to 127, and "coe1" represents a coefficient for optimizing the degree of modulation. The contents thereof will be described later.

Assuming now that the coefficient coe1 is 1, then the string length LENG is modulated so that the string length LENG0 corresponding to the key code is multiplied by an integer of 1−128 in accordance with the strength of the after-touch. However, this modulation factor is too large to provide vibrato. It is considered that the range of the modulation frequency suitable for providing a vibrato effect is from about 1.5 to about 8 Hz and that the suitable range of the modulation depth is from 0.02 to 0.05. Because, in this case, the modulation frequency is a frequency corresponding to the change of the strength of the after-touch, the modulation frequency depends on the performer's vibrato operation. On the other hand, the modulation depth is determined by the coefficient coe1. To attain the degree of modulation of 0 to 0.02 for the after-touch data aa changing in the range of from 0 to 127, the coefficient coe1 is set to $1.6 \times 10^{-5}$. To attain the degree of modulation of 0–0.05, the coefficient coe1 is set to $3.9 \times 10^{-4}$. Accordingly, the degree of modulation can be determined in a range of from 0.02 to 0.05 by setting the coefficient coe1 to a value in a range of from $1.6 \times 10^{-5}$ to $3.9 \times 10^{-4}$.

The equation Eq10 is based on the fact that vibrato control is provided to decrease the pitch. Accordingly, vibrato control acting to increase the pitch cannot be provided. Therefore, modulation can be made according to the following equation Eq11 in the case where vibrato control acting to increase the pitch is to be provided.

$$LENG = LENG0 \times (aa - 64) \quad \text{(Eq11)}$$

According to the equation Eq11, however, the string length is departed from a desired value when the strength of the after-touch is zero. Therefore, an additional process of forbidding the string length modulation according to the equation Eq11 until receiving the first after-touch code after the key depression is carried out. Further, in the case where vibrato is should be stopped without stopping the tone generation, it is preferable that the string length operation is stopped to return the string length to LENG0 when a predetermined time is passed after the reception of the after-touch code is stopped.

Figure 10:
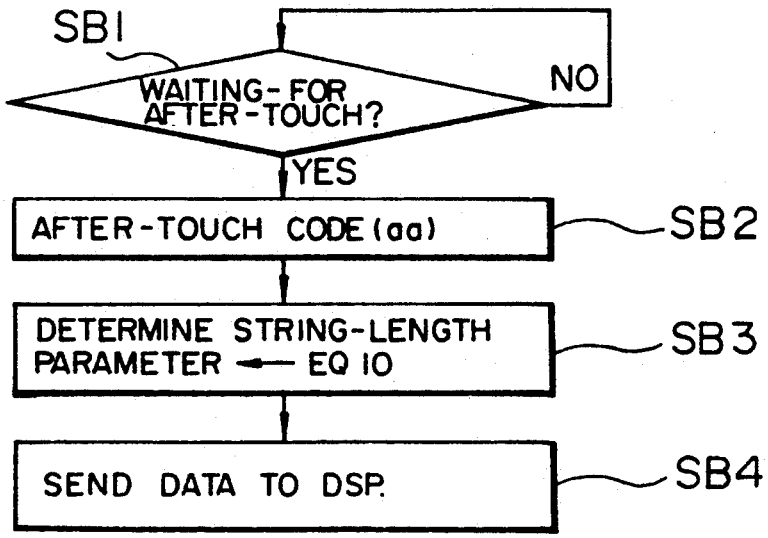
FIG. 10 is a flow chart for explaining the operation in the case where vibrato control is provided in accordance with the keyboard manipulation.

As described above, in the case where vibrato control should be provided in accordance with the keyboard operation, string length modulation shown in FIG. 10 is made. That is, the reception of the after-touch code is waited for (a step SB1). When the code is received, an after-touch data aa is extracted (a step SB2). The string length LENG corresponding to the strength of the after-touch is calculated by substituting the after-touch code aa into the equation Eq10 (a step SB3). The string length subjected to vibrato control is supplied to the tone generator 6 to thereby apply desired vibrato control to the generated tone.

Figure 11:
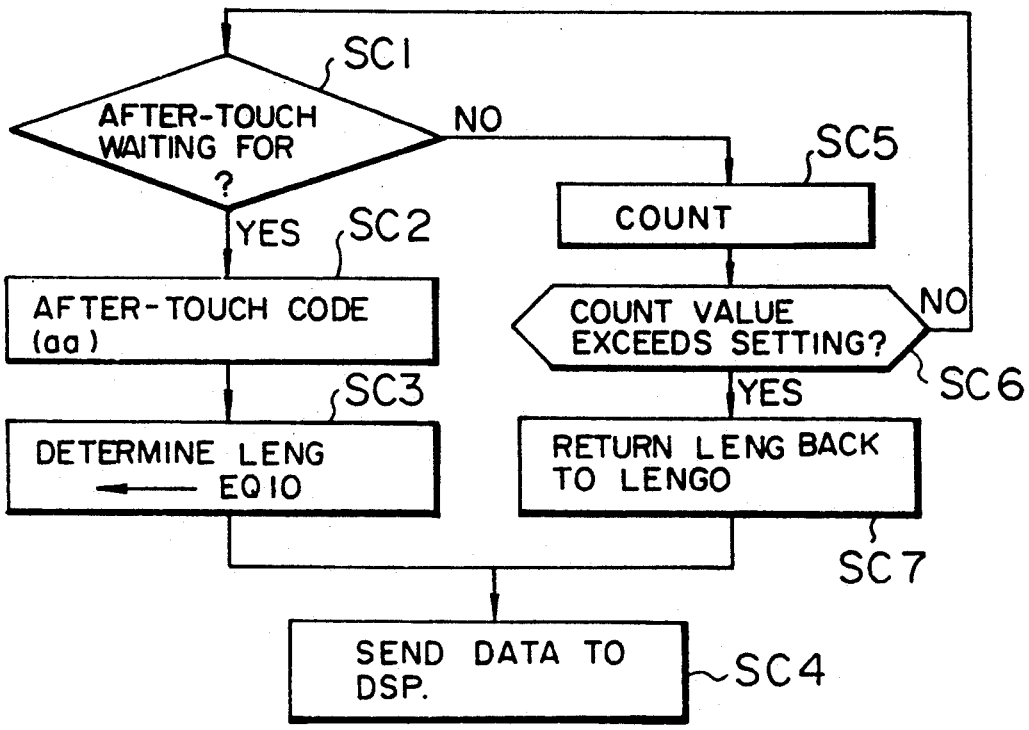
FIG. 11 is a flow chart for explaining the string length control in which vibrato control is stopped without stopping tone generation.

FIG. 11 is a flow chart showing string length modulation in which vibrato control can be stopped without stopping the tone generation. In this case, when an after-touch code is received, the same operation as shown in the steps SB1 to SB4 is made in steps SC1 to SC4. On the other hand, in the case of waiting for the after-touch code, counting is made until the code is received (a step SC5). The counting is continued until the count value indicates the passage of a predetermined time (a step SC6). When the predetermined time is passed, the string length LENG is returned to LENG0 (a step SC7). Accordingly, vibrato control is stopped without stopping the tone generation.

In the above cases, vibrato operation is attained by modulating the string length LENG. Taking vibrato of the violin which is one of natural rubbed string instruments as an example, the vibrato operation is made by moving a finger on the string. Accordingly, the bridge-side string length does not change but the length of the nut-side string length changes. In the viewpoint of this fact, it may be said that vibrato control provided by modulating only the nut-side string length dly2 conforms more closely to the actual mechanism. However, the string length attained by the shift register not only has the dimension of physical length but contains other dimensions such as the mass of the string, the torsion thereof, etc. Strictly speaking, both the string lengths dly1 and dly2 change even in the case where vibrato control is provided by changing only the nut-side string length. The two string lengths are however different in the degree of the change. When these phenomena are considered, vibrato control provided by changing both the string length LENG and the tone color control parameter BPOS is most faithful physically but an acoustically sufficient effect can be attained by vibrato control provided by modulating the aforementioned parameter LENG or dly2.

Case where Vibrato Operation is provided by using After-Touch (2)

Figure 12:
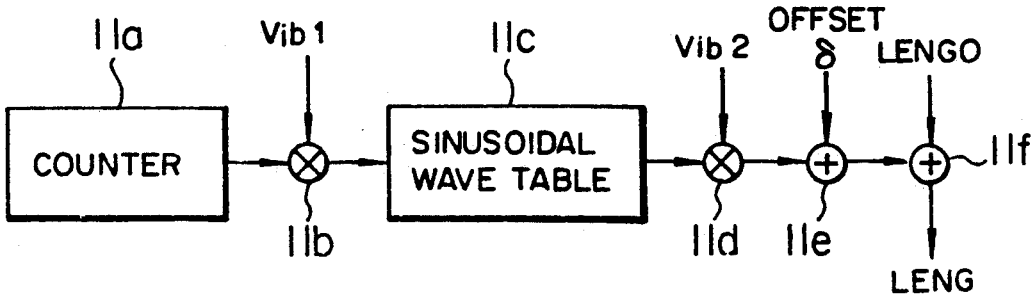
FIG. 12 is a diagram showing another example in which vibrato control is provided by after-touch.

FIG. 12 is a diagram showing another example in which vibrato control is provided by using after-touch. A multiplier 11*b* multiplies an output from a counter 11*a* by a data Vib1 expressing the depth of string length modulation. A sinusoidal waveform table 11*c* is constituted by an ROM storing a sinusoidal waveform. A multiplier 11*d* multiplies the data read from the sinusoidal waveform table by a data Vib2. An adder 11*e* adds an offset δ to the output from the multiplier 11*d*. An adder 11*f* adds the output from the adder 11*e* to the string length LENG0.

According to the aforementioned configuration, a result obtained by multiplying the output from the counter 11*a* by Vib1 is supplied as a reading address to the sinusoidal waveform table 11*c*, so that a sinusoidal waveform having the frequency changing in accordance with the value of Vib1 is read from the table. When, for example, the value of Vib1 is larger than 1, the frequency of the output sinusoidal waveform becomes high. Because thinning-out or overlapping of data read from the sinusoidal waveform table 11*c* may occur in the period of addressing the sinusoidal waveform table 11*c*, predetermined interpolation is made. The thus obtained sinusoidal waveform is multiplied by Vib2, so that a sinusoidal waveform having the amplitude corresponding to Vib2 is obtained. Further, the time average of the sinusoidal waveform is set arbitrarily by adding an offset δ to the sinusoidal waveform. The instantaneous string length LENG at the vibrato time is calculated by adding the string length LENG0 corresponding to the key code to the arbitrary sinusoidal waveform. Vibrato control is provided to the generated tone by supplying the thus obtained string length LENG to the tone generator 6. Although description shows the case where the string length LENG is modulated, the present invention can be applied the case where the string length LENG may be replaced by dly2 so that dly2 is modulated.

Figure 13:
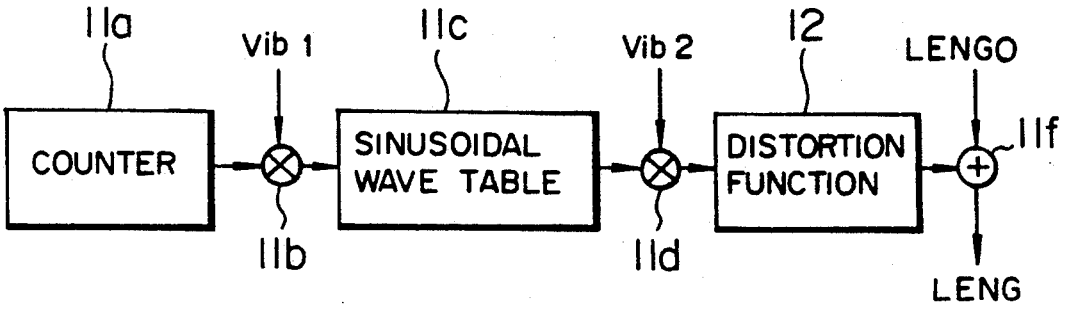
FIG. 13 is a block diagram showing the case where string length control is provided by a distorted sinusoidal waveform.
Figure 14:
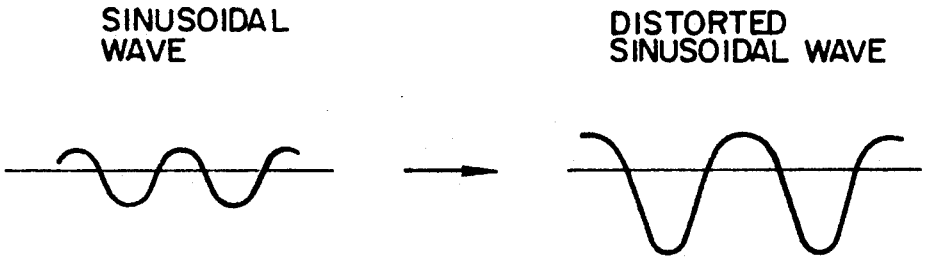
FIG. 14 is a view showing an example of a distorted sinusoidal waveform.

FIG. 13 is a block diagram showing the configuration in the case where the string length is modulated by a distorted sinusoidal waveform. FIG. 13 is different from FIG. 12 in that the adder 11*e* is replaced by a distortion function 12. The distortion function 12 applies nonlinear conversion to the input. According to the aforementioned configuration, a sinusoidal waveform having the amplitude controlled is supplied to the distortion function 12 to thereby obtain a distorted sinusoidal waveform as shown in FIG. 14. The reason why the distorted sinusoidal waveform is generated is as follows. That is, when the string length is modulated in the performance of the violin, a soft time waveform and a sharp time waveform are formed in the tone-up direction and in the tone-down direction, respectively, as expressed by the distorted sinusoidal waveform in FIG. 14. Accordingly, a vibrato effect more perfectly approaching the actual effect of the rubbed-string instrument can be attained by modulating the string length by the distorted sinusoidal waveform.

The values of Vib1 and Vib2 are preferably set so that the modulation frequency and the modulation depth are respectively in a range of about 1.6 to about 8.0 Hz and in a range of about 0.02 to about 0.05 as described above. When, for example, vibration control is provided so that Vib1 is kept constant but Vib2 increases as the strength of the after-touch increases, vibrato control can be provided so that the vibrato speed is constant but the vibrato depth increases as the strength of the key touch increases. When, on the contrary, vibration control is provided so that Vib2 is kept constant but Vib1 increases as the strength of the after-touch increases, vibrato control can be provided so that the vibrato depth is constant but the vibrato speed increases as the strength of the key touch increases.

In the case where the two parameters Vib1 and Vib2 are controlled in accordance with the strength of the after-touch, the relation between the two parameters Vib2 and Vib1 may be expressed by a linear function so that when the proportional coefficient in the linear function has a positive value, the depth of modulation increases as the vibrato speed increases and the depth of modulation decreases as the vibrato speed decreases. In the case where more complex correspondence is to be attained, a method in which the data table of Vib1 using Vib2 as an address is stored in a memory may be employed.

Case where Vibrato Operation is provided by Envelope Generator

Figure 15:
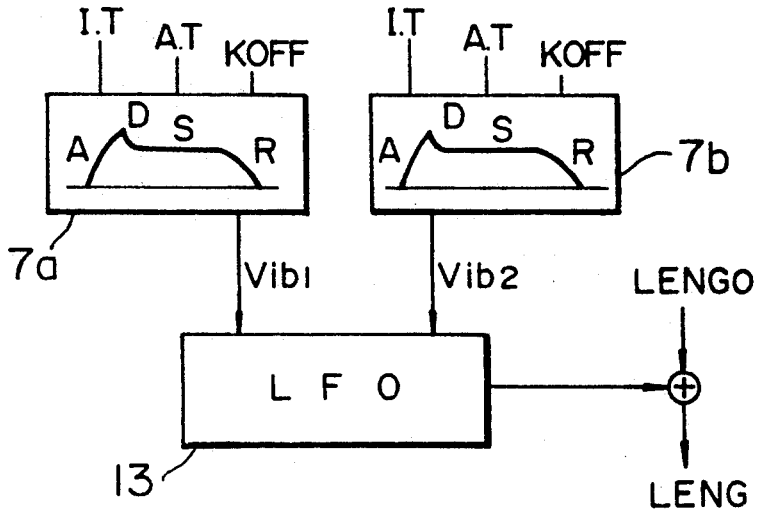
FIG. 15 is a block diagram showing an example of the configuration in the case where vibrato control is provided by an envelope generator.

The initial touch data is different from the after-touch data in that the initial touch data is not generated in any period except an instant of the key depression. Therefore, vibrato control is provided by the structure shown in FIG. 15. That is, the outputs of envelope generators 7*a* and 7*b* controlling the amplitude of the musical tone in accordance with the initial touch, after-touch and key-on are respectively used as Vib1 and Vib2 and supplied to a low-frequency oscillator (LFO) 13. In the LFO 13, the oscillation frequency and the amplitude are controlled by these data Vib1 and Vib2. Accordingly, the vibrato speed and the vibrato depth can be controlled in the same manner as described above.

B-1b Designation of Tone Length

In the rubbed string model using the nonlinear tone synthesizing method, tone generation starts when suitable values are given to the parameters expressing the bow pressure and the bow speed. An embodiment in which the envelope generators 7 are started in response to the key depression to supply the outputs of the envelope generators 7 as the bow pressure and the bow speed to the tone generator 6 to thereby generate a musical tone, will be described hereunder.

Figure 16:
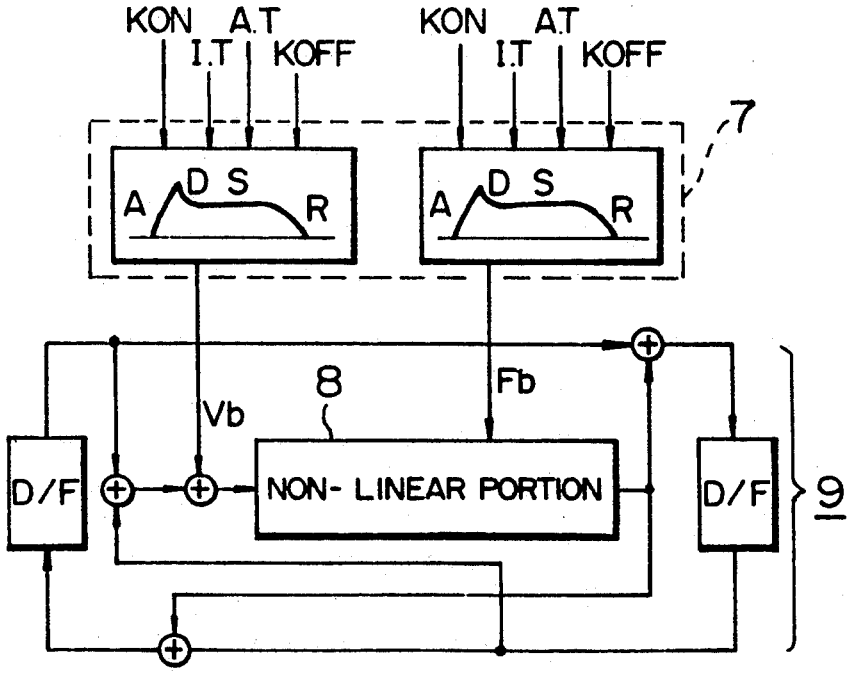
FIG. 16 is a block diagram showing the configuration of a third embodiment of the present invention.

FIG. 16 is a block diagram showing the configuration of a further embodiment in which the outputs from the envelope generators 7 are supplied as bow pressure and bow speed to the tone generator 6 (see FIG. 4). The envelope generators 7 shown in FIG. 16 control the attack portion A, the decay portion D, the sustain portion S and the release portion R of the output waveform in accordance with the key-on/off, the initial touch and the after-tough generated by the keyboard manipulation to thereby form a predetermined envelope waveform.

According to the aforementioned configuration, the envelope generators 7 are started in response to the key-on signal generated by the key depression, so that the attack portion A (the rising-up portion of the envelope waveform) is determined by the initial touch data generated with the key-on signal. When the envelope waveform reaches its peak, the delay portion D is determined and then the sustain portion S is determined on the basis of the after-touch data. Then, the release portion R is determined by the key-off signal, so that a predetermined envelope waveform is formed. Not only a tone resembling the tone of a rubbed string instrument is generated from the generation in response to the key depression but the tone generation is stopped in response to the key release, by controlling the envelope waveform to obtain a suitable bow speed and a suitable bow pressure and then supplying the bow speed envelope waveform and the bow pressure envelope waveform as signals Vb and Fb to the tone generator 6.

In the rubbed string model, the starting and stopping of tone generation can be controlled by operating both the bow speed and the bow pressure as described above. Alternatively, the starting and stopping of tone generation can be controlled by controlling a decay coefficient in a DC decay circuit (see FIG. 4). The decay coefficient expresses the decay of the DC components of the amplitude of string vibration in a process in which a string vibration wave propagates on a string from a terminal to a terminal until the wave makes a round. In an ideal string, the decay coefficient is 1, because the wave can make rounds on the ideal string without decay. In the case where tone generation is made to simulate the tone of the rubbed string instrument, the decay coefficient is generally in a range of from about 0.9 to about 0.99. In the program flow shown in FIG. 6, the terminal end of the string is disposed so closely to a fixed end that phase inversion occurs. Accordingly, a value in a range of from about −0.9 to about −0.99 is given as terminal reflection. Accordingly, the starting and stopping of tone generation can be attained by controlling the terminal reflection through the key depressing operation. That is, the control corresponding to the key depressing operation can be provided so that the terminal reflection is set to 0 when there is no key depression and so that the terminal reflection is set to a value in a range of from −0.9 to −0.99 when a key is depressed.

The starting and stopping of tone generation can be also attained by controlling the characteristic of the filter circuit (see FIG. 4) simulating the propagation characteristic of string vibration. In this case, the starting and stopping of tone generation can be attained by controlling the amplitude characteristic of the filter circuit. Controlling the amplitude characteristic is equivalent to controlling the aforementioned decay characteristic. Because the phase characteristic, however, changes when the filter characteristic changes, this method has an influence on the pitch of the generated tone. In the case where the influence is not bad, this method can be put into practice. When, for example, a low-pass filter is used as the filter and tone generation is not continuous, the total passing quantity of string vibration is decayed by moving the cutoff frequency to the low-pass side. As a result, tone generation stops while the pitch changes.

In the case where generation of a new tone is designated in a state in which the tone generator 6 generates a tone, it is necessary to apply forced damping treatment to forcedly damp the previous tone generation. The forced damping treatment can be attained easily by setting the aforementioned terminal reflection to 0.

B-1c Designation of Tone Strength

In the rubbed string model using the nonlinear tone synthesizing method, the output volume of the tone is controlled in accordance with the values of the bow pressure and the bow speed. When, for example, the bow pressure and the bow speed are controlled so that these values increase as the strength of the initial touch increases, designation of the tone strength can be made without incompatibility. The tone strength can be changed also simply by controlling the output gain.

B-1d Designation of Tone Quality

In this case, the parameter for changing the tone quality can be generated through measuring/processing the speed of key depression and on the basis of the result thereof. For example, the cutoff frequency of the low-pass filter circuit in the linear portion 9 (see FIG. 4) is changed in accordance with the initial touch data. When the cutoff frequency of the filter circuit is controlled so that the cutoff frequency increases as the quantity of the initial touch increases, the tone can contain high-pitch high-degree harmonics so that the "light" tone quality can be provided.

In the rubbed string model, the tone generation spectra of the musical tone change as the rate of bow pressure to bow speed changes. When this rate exceeds a certain range, a tone not containing low-pitch components such as a fundamental tone and the like may be generated or tone generation may be impossible. When this rate is controlled in accordance with the initial touch and after-touch, the change of tone color can be attained according to the performer's style.

The tone color of the output tone can be changed also by controlling the resonance characteristic in the rubbed string model. For example, resonance systems different in characteristics are provided in accordance with the pitch range of the generated tone to thereby change the tone color. Further, the tone color can be changed by controlling the filter characteristic in the tone output portion.

B-1e Key Assign

A key depression process is carried out in a period of from the key depression to the key release. When another key is depressed in the key depression process, tone generation is assigned on the basis of a predetermined rule in accordance with limitation in the number of tone generators, limitation in the maximum number of tone generation channels or the performance style.

Legato on the Same String in Monophonic Mode

The operation in the case where legato performance on the same string in a monophonic mode is provided will be described hereunder with reference to FIGS. 17 and 18. In this example, key assign based on the last arrival top priority rule is used. The last arrival top priority rule is a rule in which top priority is given to keyboard processing for the last depressed key when a plurality of keys are depressed at once. Assuming now that keyboard operations are made in order of "depression of key α", "depression of key β", "release of key β" and "release of key α", then the situation of the procedure goes to a step SD1 and information of key α is written in a key buffer in response to the depression of key α. Then, in a step SD2, a key scale data corresponding to the key α is generated and supplied to the DSP (see FIG. 4) constituting the tone generator 6. The key scale data is a data giving the quantity of delay to be controlled in accordance with the string length or a data giving the passing characteristic of the filter. In a step SD3, a judgment is made as to whether the depressed key is first or not. When the depressed key is first, the result of the judgment is "YES" and the situation of the procedure goes to the next step SD4. In the step SD4, the envelope generator is started to generate bowing information. That is, the envelope generator controls output waveforms in order of "attack portion", "decay portion" and "sustain portion" through the key depressing operation to generate bowing information. The bowing information thus generated is supplied to the DSP to thereby start the tone generation of the key α (a step SD5). Thereafter, the aforementioned steps SD1 to SD3 are executed again in response to the depression of the key β. Because the depressed key is the second one, the result of the judgment in the step SD3 is "NO" and the key depression process is stopped. As a result, legato performance in which the pitch changes while the tone is continued is provided.

Figure 18:
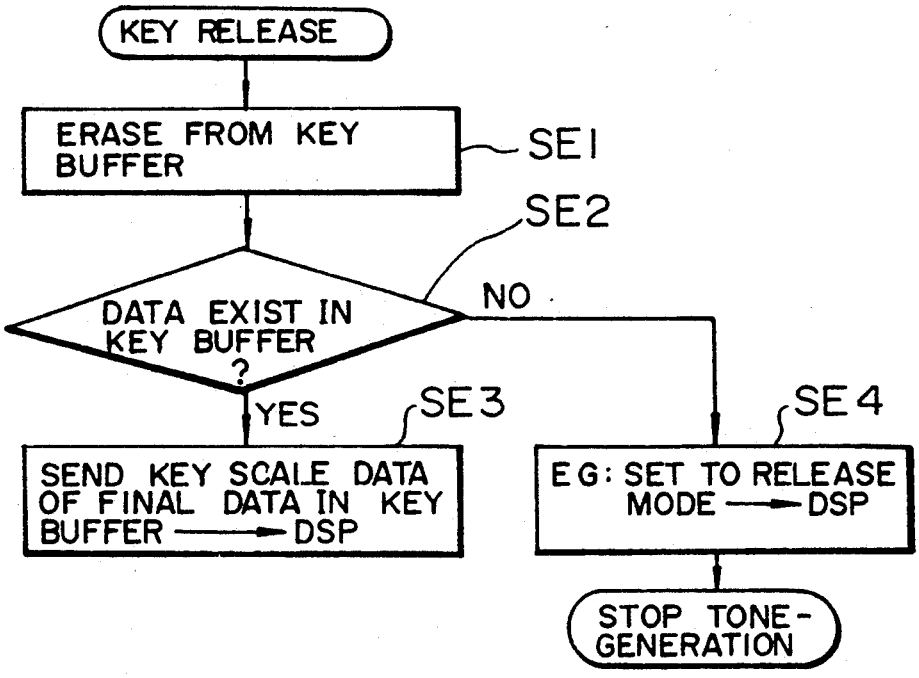
FIG. 18 is a flow chart for explaining the operation in the case where legato performance on the same string in a monophonic mode is attained.

When the key β is then released, the situation of the procedure goes to a step SE1 in FIG. 18 and the information of the key β written in the key buffer is erased. Then, in a step SE2, a judgment is made as to whether the key buffer has data or not. Because the data of the key α is held in the key buffer now, the result of the judgment is "YES" and the situation of the procedure goes to the next step SE3. In the step SE3, the data finally written in the key buffer, that is, the information of the key α, is searched for and a corresponding key scale data is supplied to the DSP. As a result, the pitch of the tone changes to correspond to the key α. Thereafter, the information of the key α is erased from the key buffer in response to the release of the key α. Because there is no data held in the key buffer, the result of the judgment in the step SE2 is "NO" and the situation of the procedure goes to the step SE4. In the step SE4, the mode of the envelope generator is turned to the release mode so that tone generation is stopped after a predetermined time is passed.

Although the aforementioned embodiment has shown the case where the operation of the envelope generator is continued if the key buffer has at least one data, the present invention can be applied to the case where the envelope generator may be started/stopped whenever a key is depressed/released. Further, the aforementioned rule employed as a tone generation assign rule may be replaced by the first arrival top priority rule or the range priority rule.

Legato on Different Strings in Monophonic Mode

Figure 19:
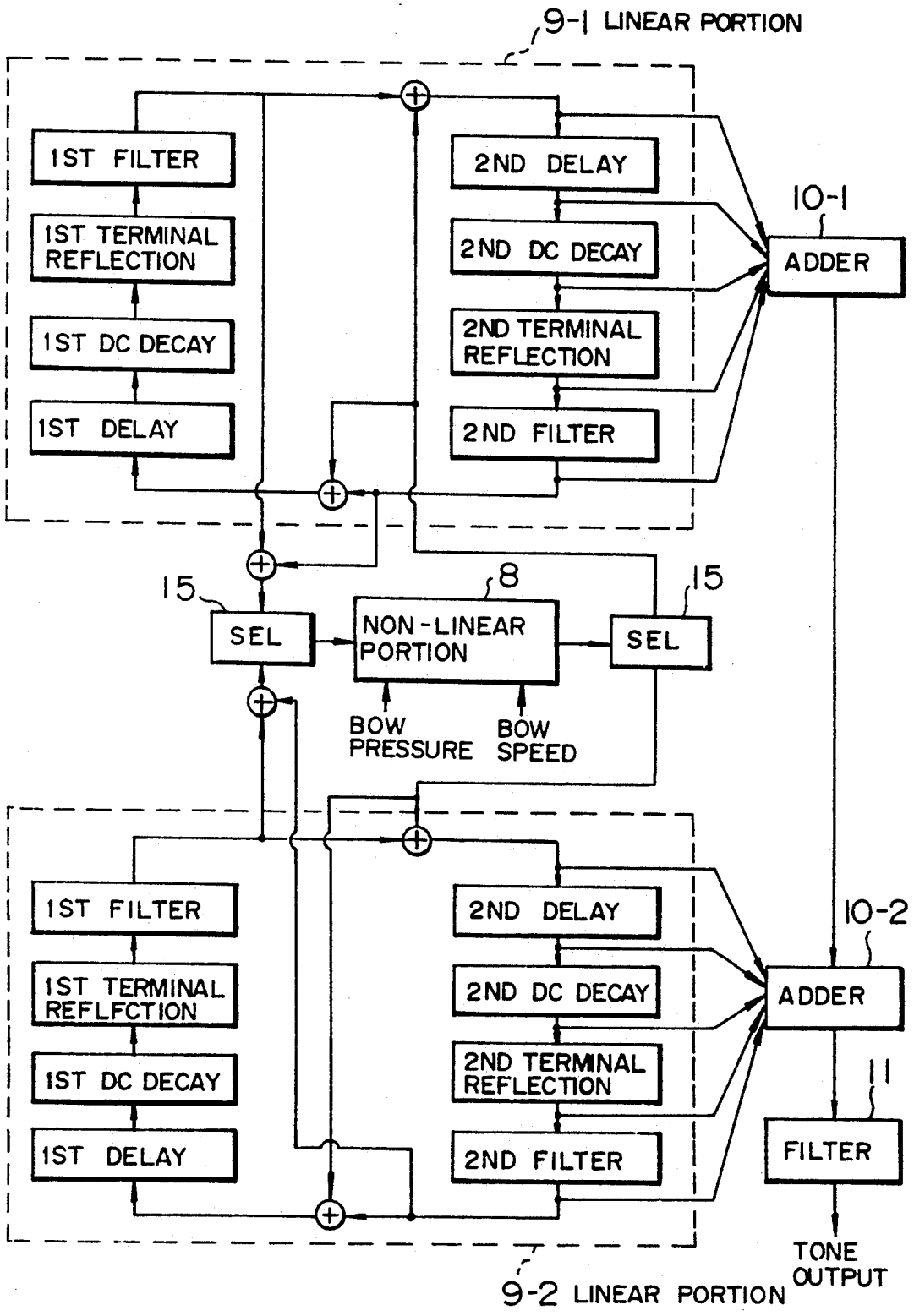
FIG. 19 is a block diagram of an example of the configuration for attaining different-string legato.

The difference between the aforementioned legato performance on the same string and the legato performance on different strings is in the point as to whether the previous tone lingers when the pitch is changed. FIG. 19 is a block diagram showing a structure for attaining such legato on different strings. The tone generator shown in FIG. 19 comprises two pairs of linear portions 9-1 and 9-2 and adder circuits 10-1 and 10-2 using a nonlinear portion 8 shown in FIG. 4 in common, a filter circuit 11, and a selector 15. The selector 15 switches the input/output between the linear portion and the nonlinear portion.

The legato operation on different strings in this structure will be described hereunder with reference to FIG. 20. It is now assumed that the keyboard manipulation is made in order of "depression of key α", "depression of key β", "release of key β" and "release of key α". When the electric source is turned on, initialization is made to set a linear portion selecting flag to A (a step SF1). When A is set in the linear portion selecting flag, the selector 15 selects the linear portion 9-1. When B is set in the flag, the selector 15 selects the linear portion 9-2. When the key α is then depressed, the situation of the procedure goes to a step SF2 and the information of the key α is written in the key buffer. Then, in a step SF3, the priority of key depression is evaluated and the situation of the procedure goes to a step SF4. In the step SF4, the information of the key α is written in the tone generation buffer. In a step SF5, a judgment is made as to what is set in the linear portion selecting flag. Because A is now set in the linear portion selecting flag by the aforementioned initialization, the situation of the procedure goes to a step SF6. In the step SF6, a signal for selecting the linear portion 9-1 is supplied to the selector 15. In the next step SF7, the envelope generator is initialized. Then, in a step SF8, B is set in the linear portion selecting flag. In a step SF9, a key scale data corresponding to the value of the tone generation buffer is generated in the linear portion 9-1 and supplied to the DSP. Then, in a step SF10, the envelope generator is started to generate bowing information and supply the bowing information to the DSP to thereby generate a tone.

When the key β is then depressed, the situation of the procedure goes to a step SF11 through the steps SF2–SF2. In the step SF11, a signal for selecting the linear portion 9-2 is supplied to the selector 15. In the next step SF12, the envelope generator is initialized. Here, the decay of the tone generation of the key α is started by the initialization. In a step SF13, A is set in the linear portion selecting flag. In a step SF14, a key scale data of the key β stored in the tone generation buffer is generated in the linear portion 9-2 and supplied to the DSP. Here, the tone of the key β is generated.

In general, the period from the point of time where the envelope generator is initialized to the point of time where the envelope generator is started is set to be smaller than the decay time constant of string vibration, so that the tone generation of the key α and the tone generation of the key β temporally overlap each other to thereby bring an effect like the effect of use of different strings.

When the key β is then released, the situation of the procedure goes to a step SG1. In the step SG1, the information of the key β is erased from the key buffer and then the situation of the procedure goes to a step SG2. In the step SG2, the result that the erased data accords with the data in the tone generation buffer is obtained and then the situation of the procedure goes to a step SG3. If the discrimination is negative, the situation is abnormal and the key release processing is terminated. In the step SG3, a judgment is made as to whether there is any data in the key buffer. Because the information of the key α remains in this case, the result of the judgment is "YES". Accordingly, the information of the key α is written in the tone generation buffer again in a step SF4, so that not only the tone generation of the key $\beta$ is decayed but the tone generation of the key $\alpha$ is started in the same manner as described above.

When the key $\alpha$ is then released, the steps SG1 to SG3 are carried out. In this case, there is no data in the key buffer, so that the result of the judgment in the step SG3 is "NO" and the situation of the procedure goes to a step SG4. In the step SG4, the mode of the envelope generator is turned to the release mode so that the tone generation is stopped after a predetermined time is passed.

Although description has been made upon the case where the aforementioned operation is applied to the legato performance style on different strings, it is a matter of course that the operation can be applied to other performance styles. Not only the aforementioned operation can be applied to the case where three or more strings are used, but caesurae of the sound can be reproduced if envelope generators are provided individually for the respective linear portions.

Bow Returning on the Same String in Monophonic Mode

Figure 17:
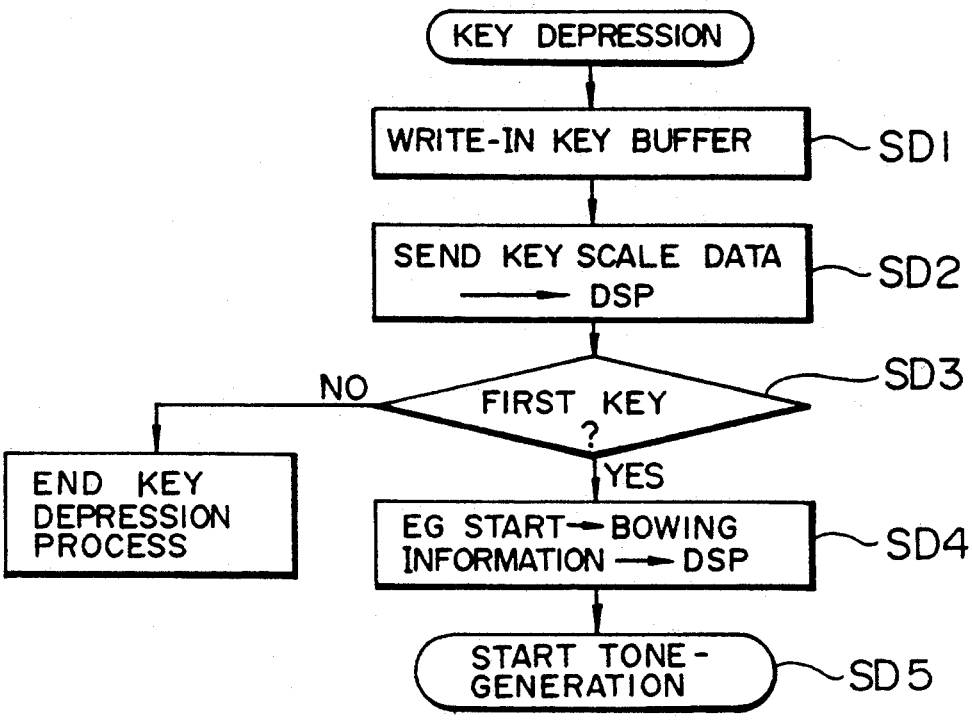
FIG. 17 is a flow chart for explaining the operation in the case where legato performance on the same string in a monophonic mode is attained.

The difference between the legato on the same string as shown in FIGS. 17 and 18 and the bow returning on the same string is in the point as to whether the envelope generator is surely started when the pitch is changed. The bow returning operation will be described hereunder with reference to FIG. 21.

Figure 21:
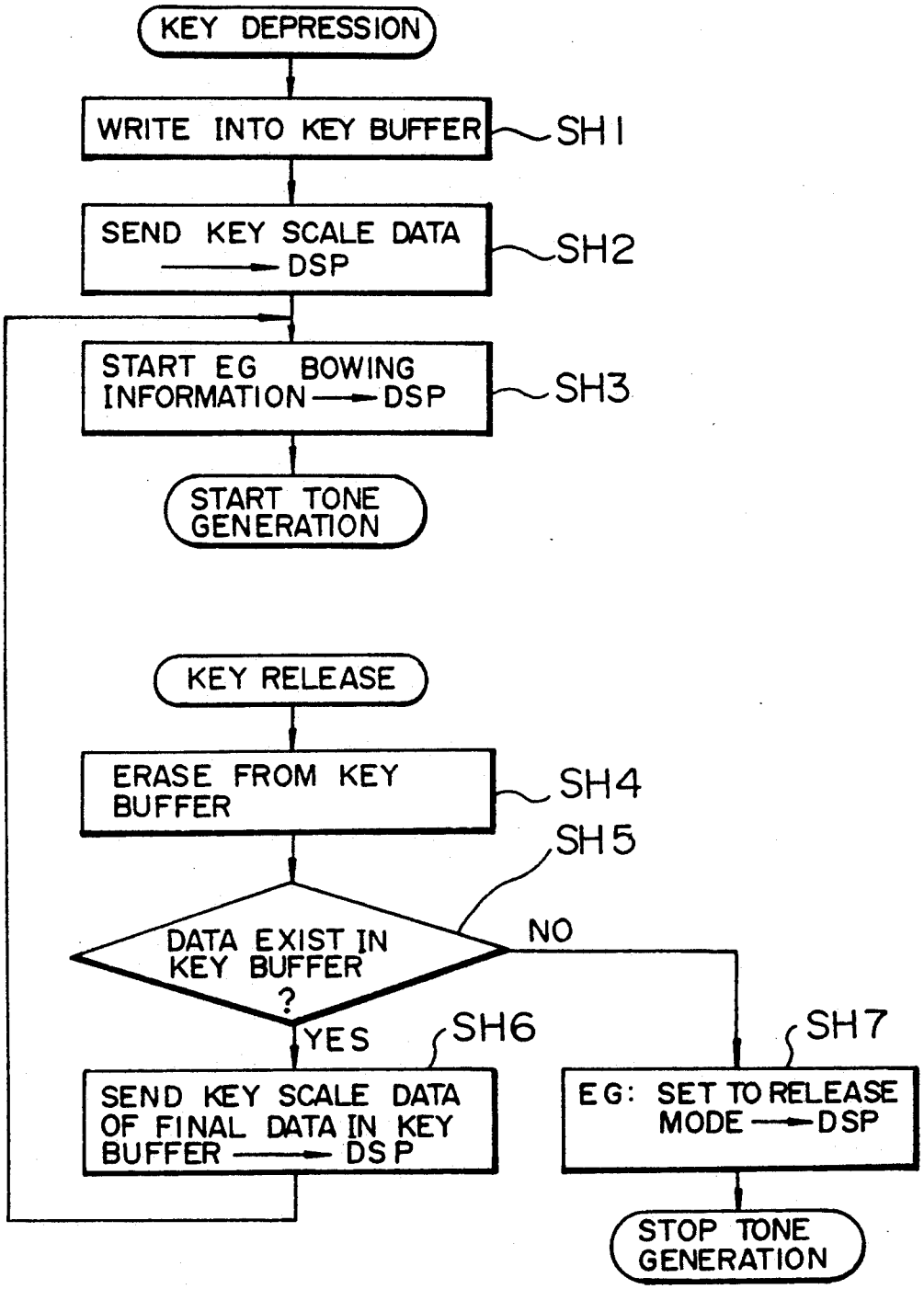
FIG. 21 is a flow chart for explaining the bow-returning operation on the same string in a monophonic mode.

Assuming now that the keyboard manipulation is made in order of "depression of key $\alpha$", "depression of key $\beta$", "release of key $\beta$" and "release of key $\alpha$", then the situation of the procedure first goes to a step SH1 in FIG. 21. In the step SH1, the information of the key $\alpha$ is written in the key buffer. When the situation of the procedure then goes to a step SH2, a key scale data corresponding to the key $\alpha$ is generated and supplied to the DSP (see FIG. 4) constituting the tone generator 6. The key scale data is a data giving the quantity of delay to be controlled in accordance with the string length or a data giving the passing characteristic of the filter. In a step SH3, the envelope generator is started to generate bowing information and supply the bowing information to the DSP to thereby start the tone generation of the key $\alpha$. When the key $\beta$ is then depressed, the steps SH1 to SH3 are carried out again to generate the tone of the key $\beta$.

When the key $\beta$ is then released, the situation of the procedure goes to a step SH4. In the step SH4, the information of the key $\beta$ written in the key buffer is erased. When the situation of the procedure then goes to a step SH5, a judgment is made as to whether there is any data in the key buffer. Because the data of the key $\alpha$ is now stored in the key buffer, the result of the judgment is "YES" and the situation of the procedure goes to the next step SH6. In the step SH6, the last data finally written in the key buffer, that is, the information of the key $\alpha$, is searched for, so that a key scale data corresponding to the information of the key $\alpha$ is supplied to the DSP to start the envelope generator. As a result, the pitch of the musical tone changes to a pitch corresponding to the key $\alpha$. When the key $\alpha$ is then released, the situation of the procedure goes to the step SH4 again and the information of the key $\alpha$ is erased from the key buffer. Because there is no data stored in the key buffer now, the result of the judgment in the step SH5 is "NO" and the situation of the procedure goes to a step SH7. In the step SH7, the mode of the envelope generator is turned to the release mode so that the tone generation is stopped after a predetermined time is passed. As described above, the effect of bow returning is provided by changing the pitch through starting the envelope generator.

In respect to actual violin playing, in the case of the bow returning, the bow speed does not act rapidly reversely but the bow returning operation contains the operation of decreasing the bow pressure a little. In this respect, a more natural change of the tone can be provided by carrying out a process of starting the envelope generator in response to the release of the key $\alpha$ just before the depression of the key $\beta$. This is made possible by using a signal expressing the key-off speed.

Range Priority in Monophonic Mode

Figure 20:
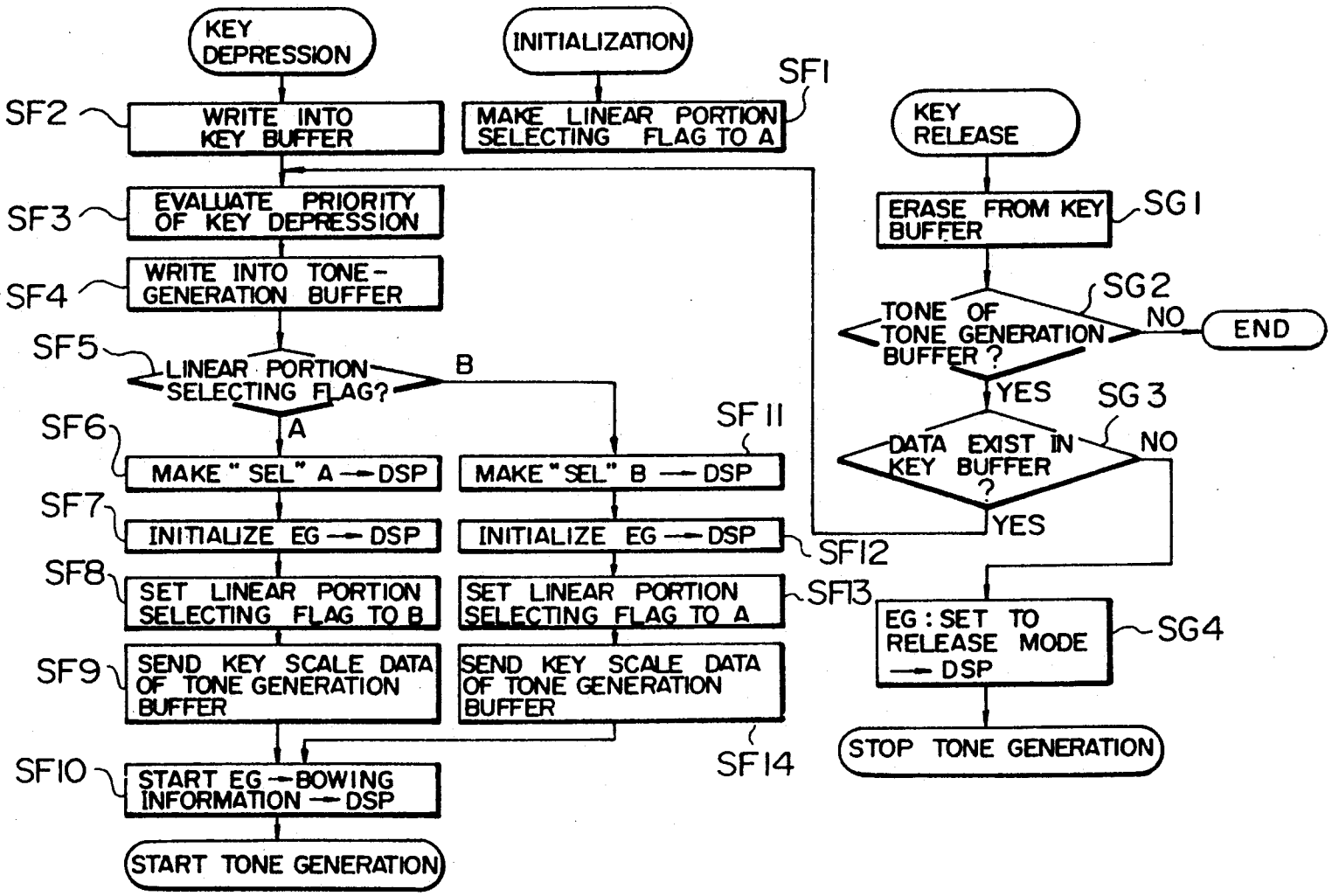
FIG. 20 is a flow chart for explaining the different-string legato operation.

To determine the priority of the key depression process on the basis of the pitch range, the keyboard priority evaluation in the step SF3 in FIG. 20 is changed. That is, the evaluation in which top priority is given to the last arrival as shown in FIG. 20 is replaced by another evaluation in which, for example, top priority is given to the tone of the highest pitch. By this evaluation, key assign of the highest pitch priority can be provided. If top priory is given to the tone of the lowest pitch, key assign of the lowest pitch priority can be provided. Further, key assign of the last arrival priority or the first arrival priority can be provided by forming a structure in which a sequence of depressed keys is stored as information.

If priority for each tone is stored in a memory, higher priory can be given to pitches in the tonic triad of some key or higher priority can be given to pitches in some range. In the method using a memory, the order of priority may be stored for each tone or the order of priority may be stored for each group obtained by classifying tones into groups by ranges. In the latter case, memory capacity can be saved by setting the priority for each group and employing key assign of the highest pitch priority or the lowest pitch priority.

Polyphonic Mode

Figure 22:
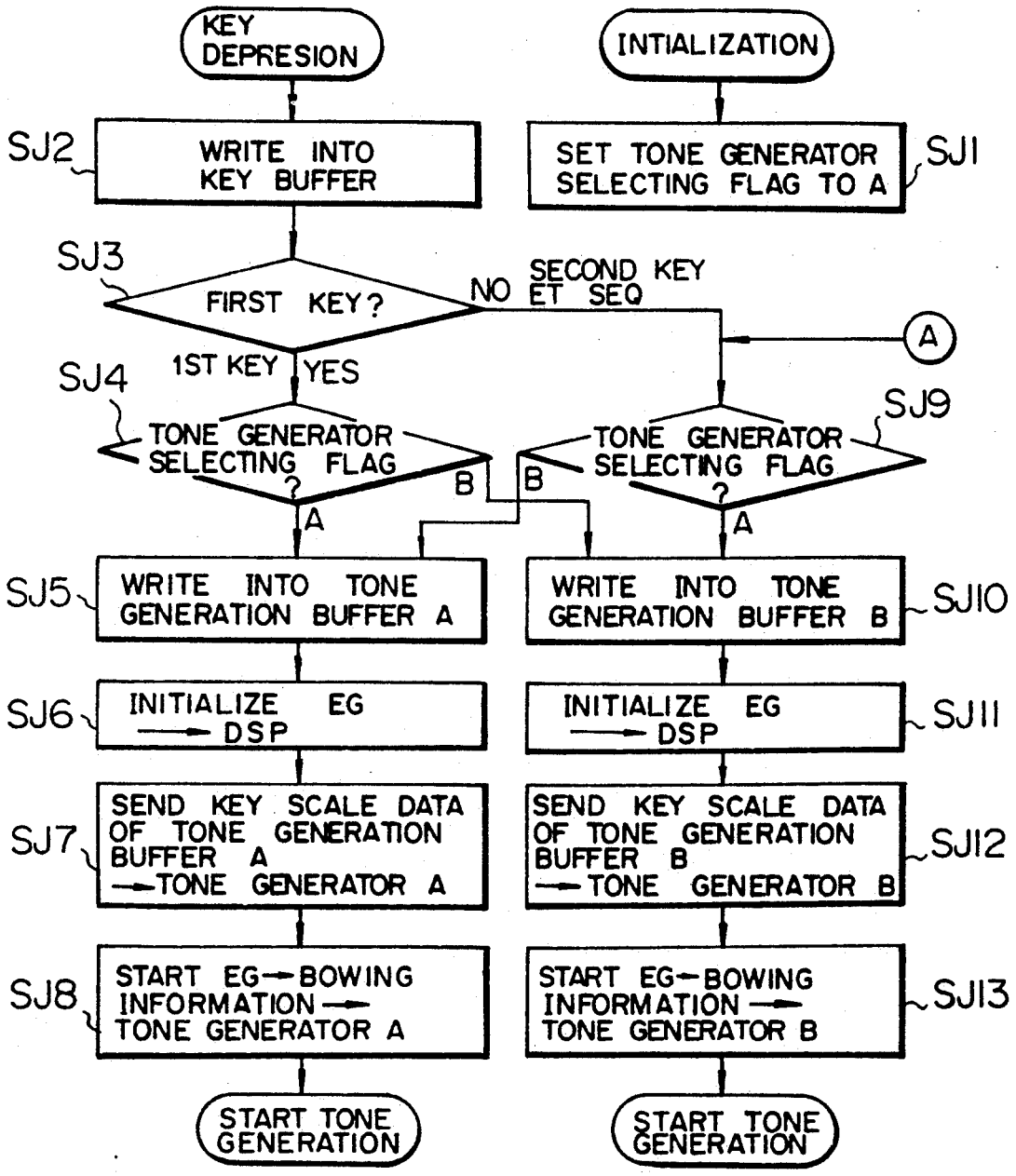
FIG. 22 is a flow chart for explaining the operation in a polyphonic mode.

The operation will be described hereunder with reference to FIG. 22 in the case where the number of tones generated is limited to two, that is, in the case where polyphonic tone generation is made through setting assign priority for the first and second tones. It is now assumed that the keyboard manipulation is made in order of "depression of key $\alpha$", "depression of key $\beta$", "depression of key $\gamma$", "release of key $\alpha$", "release of key $\beta$" and "release of key $\gamma$".

When the electric source is turned on, initialization is made to set a tone generator selecting flag to A (a step SJ1). When A is set in the tone generator selecting flag, the tone generation buffer A for the tone generator A is selected. When B is set in the tone generator selecting flag, on the contrary, the tone generation buffer B for the tone generator B is selected.

When the key $\alpha$ is then depressed, the situation of the procedure goes to a step SJ2 and the information of the key $\alpha$ as the first tone written in the key buffer. Then, in a step SJ3, a judgment is made as to whether the information written in the key buffer is first or not. Because the information is first in this case, the result of the judgment is "YES" and the situation of the procedure goes to the next step SJ4. In the step SJ4, a judgment is made as to what is set in the tone generator selecting flag. Because the flag is now set to "A" by the initialization, the situation of the procedure goes to a step SF5. In the step SF5, the information of the key $\alpha$ is written in the tone generation buffer A. In a step SJ6, the envelope generator is initialized. In a step SJ7, a key scale data corresponding to the value of the tone generation buffer A is supplied to the tone generator A. Then, in a step SJ8, the envelope generator is started to generate bowing information and supply the bowing information to thereby start the tone generation of the key $\alpha$.

When the key $\beta$ is then depressed, "NO" is obtained as the result of the judgment in the step SJ3 and the situation of the procedure goes to a step SJ9. In the step SJ9, a judgment is made as to what is set in the tone generator selecting flag. Because the tone generator selecting flag is now set to A, the situation of the procedure goes to a step SF10. In the step SF10, the information of the key $\beta$ is written in the tone generation buffer B. Thereafter, the tone generation of the key $\beta$ is made through steps SJ11 to SJ13. When the key $\gamma$ is then depressed, not only the tone generation of the key $\beta$ is stopped but the tone generation of the key $\gamma$ is started through the steps SJ9 to SJ13.

Figure 23:
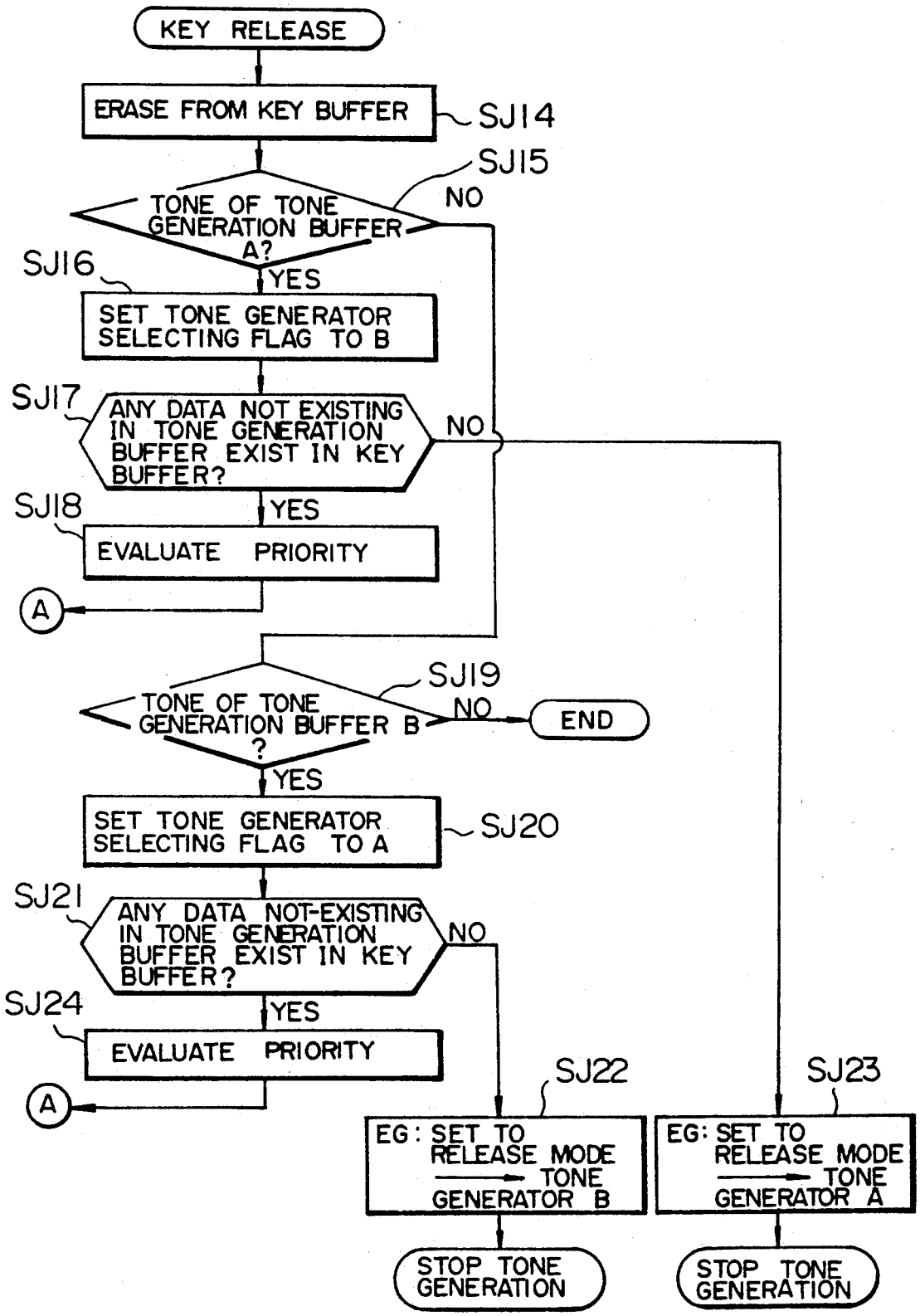
FIG. 23 is a flow chart for explaining the operation in a polyphonic mode.

When the key $\alpha$ is then released, the situation of the procedure goes to a step SJ14 in FIG. 23. In the step SJ14, the information of the key $\alpha$ is erased from the key buffer and then the situation of the procedure goes to a step SJ15. In the step SJ15, a judgment is made as to whether the erased information is of the tone generation buffer A. Because the information in this case is of the tone generation buffer A, the result of the judgment is "YES" and the situation of the procedure goes to a step SJ16. In the step SJ16, the tone generator selecting flag is set to B and then the situation of the procedure goes to a step SJ17. In the step SJ17, the key buffer is searched to thereby judge whether there is any data which does not exist in the tone generation buffer B. Because information existing in the tone generation buffer B is of the key $\beta$, the result of the judgment is "YES" and the situation of the procedure goes to the next step SJ18. In the step SJ18, the priority of the key is evaluated. Because only one data of the key $\beta$ exists now, the priority evaluation is provided as information of the key $\beta$. When the situation of the procedure goes to the aforementioned process from the step SJ9 onward, the information of the key $\beta$ is written in the tone generation buffer A because the tone generator selecting flag is already changed to B. As a result, the envelope generator is initialized to stop the tone generation of the key $\alpha$ which has been continued up to now. Subsequent to this, a key scale data corresponding to the tone generation buffer A is supplied to the tone generator A. Then, the envelope generator is started, so that the tone generator starts tone generation corresponding to the key $\beta$. In this condition, the tone generator A generates the tone of the key $\beta$ and the tone generator B generates the tone of the key $\gamma$.

When the key $\beta$ is then released, "YES" is obtained as the result of the judgment in the step SJ15 and the situation of the procedure goes to the step SJ16. In the step SJ16, the tone generator selecting flag is set to B and then the situation of the procedure goes to the step SJ17. In the step SJ17, the key buffer B is searched to thereby judge whether there is any data which does not exist in the tone generation buffer B. Because there is no data now, the result of the judgment is "NO" and the situation of the procedure goes to the next step SJ23. In the step SJ23, the mode of the envelope generator is set to the release mode to stop the tone generation of the key $\beta$.

When the key $\gamma$ is then released, the information of the key $\gamma$ is erased from the key buffer. Because this is the tone of the tone generation buffer B, the result of the judgment in the step SJ15 is "NO" and the tone generator selecting flag is set to A (a step SJ20). The discrimination in the step SJ19 is ordinary "YES". If the discrimination is "NO", the situation is abnormanl and the key release processing is terminated. There is, however, no data in the key buffer. Accordingly, the result of the judgment in a step SJ21 is "NO" and the situation of the procedure goes to a step SJ22. In the step SJ22, the mode of the envelope generator is set to the release mode to stop the generation of the key $\gamma$. In this condition, key depression is waited for while the tone generator selecting flag is still set to A. Here, a step SJ24 is a step of evaluating priority for the second tone. In the evaluation, top priority is given to the last arrival.

Fingering

The violin as a typical rubbed string instrument has four strings so that the same pitch can be provided by a plurality of strings. In respect to the same pitch, the tone color changes according to the string used. Therefore, the performer considers both the easiness of fingering and the difference in tone color to thereby select the string to be used. There are differences in tone color change, lingering and the like between the performance using only one string and the performance using a plurality of strings. These differences are factors forming something of the rubbed string instrument. To attain the aforementioned string performance style, that is, to attain the performance style called fingering, a multistage keyboard having tone generators corresponding to the strings and making the same fingering as that of the violin possible may be used.

Nonlinear Portion for controlling Smoothness

When a rubbed string model is constituted by a digital circuit, pull-in oscillation may occur particularly in high pitch ranges according to the sampling frequency or noise may be produced by interference with the oscillation frequency of a predetermined musical tone. This is because the nonlinear portion 8 (see FIG. 4) for simulating the friction characteristics between string and bow in the rubbed string model operates so as to transit between two states of dynamic friction and static friction. Therefore, the pull-in oscillation or noise production can be prevented by controlling the state transition smoothly.

Figure 24:
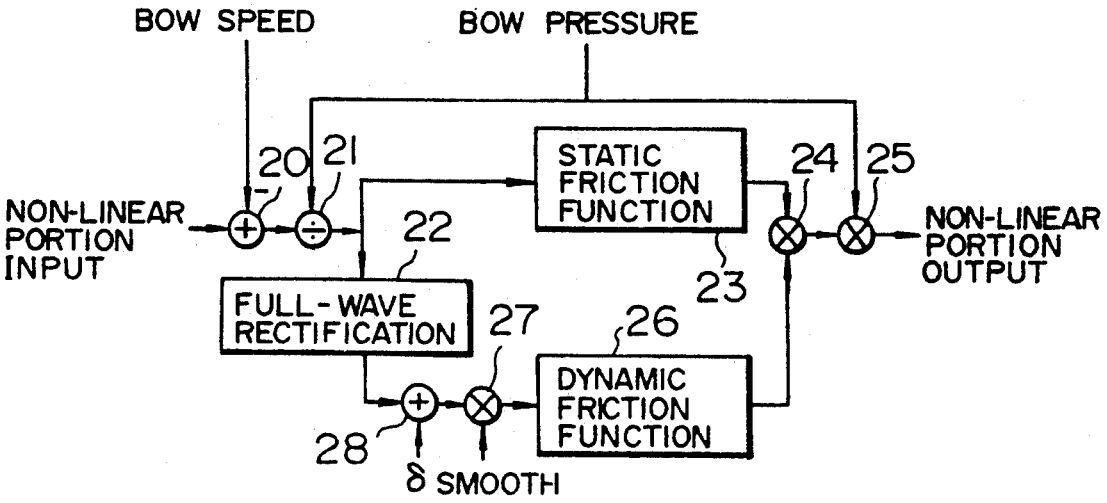
FIG. 24 is a block diagram showing an example of the configuration of the nonlinear portion 8 for providing smooth control.
Figure 25:
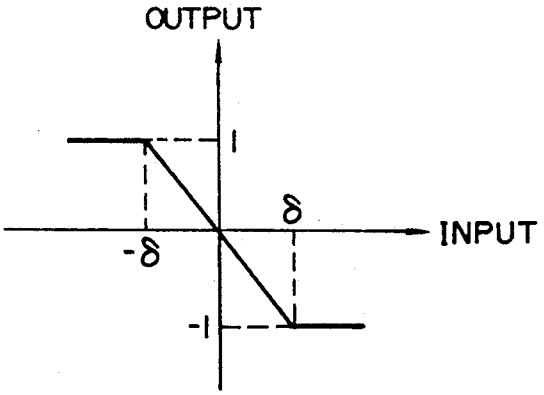
FIG. 25 is a graph showing a static friction function stored in the static friction function circuit 23.
Figure 26:
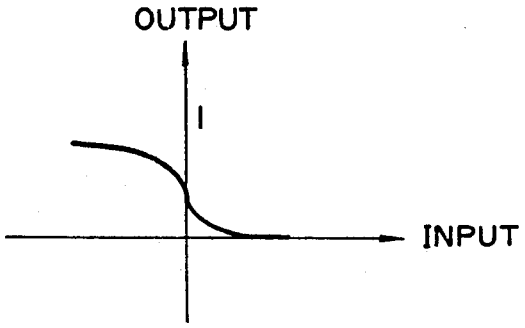
FIG. 26 is a graph showing a dynamic friction function stored in the dynamic friction function circuit 26.

FIG. 24 is a block diagram showing a structure of the nonlinear portion 8 for providing such smooth control. In the drawing, the reference numerals 20 and 28 designate adders; 24, 25 and 27 multipliers; and 21 a divider. A full-wave rectification circuit 22 makes full-wave rectification of the input signal and outputs the result of the rectification. A static friction function circuit 23 is constituted by an ROM in which a static friction function shown in FIG. 25 is stored as a data table. A dynamic friction function circuit 26 is constituted by an ROM in which a dynamic friction function shown in FIG. 26 is stored as a data table.

Figure 27:
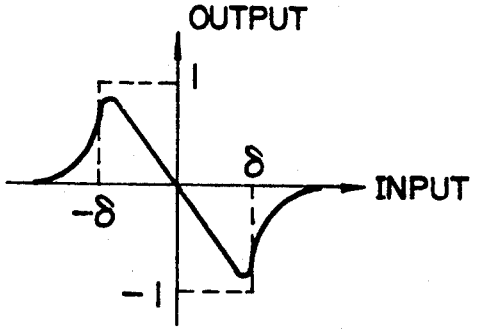
FIG. 27 is a graph showing a synthetic nonlinear function which is synthesized from the static friction function and the dynamic friction function.
Figure 28:
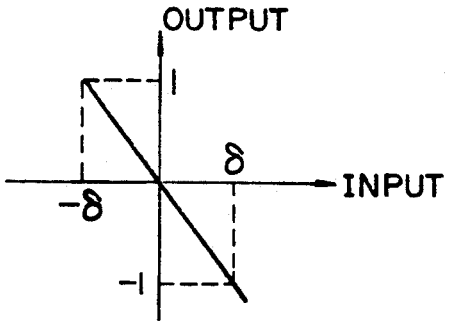
FIG. 28 is a graph showing a synthetic nonlinear function in the case where the parameter "smooth" is set to be large.

According to the structure, when the parameter "smooth" supplied to the multiplier 27 is 1, both the static friction function and the dynamic friction function are directly read out to form a smooth synthetic nonlinear function shown in FIG. 27. When the parameter "smooth" increases to a higher value, the input-output relation shown in FIG. 28 is provided finally.

In practical use, the parameter "smooth" may be controlled whenever a key is depressed to start the envelope generator to thereby generate a tone. In the rising-up portion of the tone, however, the roughness thereof must be rather noticed though noise and pull-in oscillation may be neglected. Therefore, in the rinsing-up portion of the tone, discontinuous transition between dynamic friction and static friction is selected rather than smooth transition. On the contrary, in the sustaining portion of the tone, instability of the pitch and noise must be rather noticed. Therefore, in this case, smooth transition is preferably selected.

B-2 Rubbed String Model using Foot Controller

The foot controller is also called "foot expression pedal" and used as a volume control manipulator in the electronic organ and the like. This manipulator is manipulated with foot, so that dynamic control can be provided though a delicate nuance cannot be provided in a performance. Respective rubbed string models for designating the pitch, the tone length, the tone strength and the tone quality through the manipulation of the foot controller will be described hereunder.

B-2a Designation of Pitch

Vibrato Control

The same vibrato control as described above is provided by modulating the string length by data of the foot controller in the same manner as the string length control based on the after-touch data as shown in FIGS. 10 and 11.

Portamento Performance

The change of the tone generation frequency due to vibrato is about 10 cent at the most. If the change is increased to such a large value that covers a plurality of keys, a portamento effect can be provided. For example, in the operation flow shown in FIG. 10, data of the foot controller are used in the step SB2. In the next step SB3, string length modulation corresponding to the portamento performance style is provided by setting the coefficient coe1 of the equation Eq10 to a predetermined value larger than that in vibrato control. When the portamento width is equivalent to an octave, the coefficient coe1 is determined in accordance with the controller output so that the degree of modulation changes by a value in a range of from 1.0 to 0.5 at the time of ascending pitch and changes by a value in a range of from 1.0 to 2.0 at the time of descending pitch.

B-2b Designation of Tone Length

Envelope Generator Control

When the release time in the envelope generator is controlled corresponding to the output from the foot controller, lingering at the time of the stopping of tone generation can be controlled.

DC Decay Characteristic Control

Stopping of tone generation independent of bowing information can be provided by controlling the passing characteristic quantity in the DC decay circuit (see FIG. 4) on the basis of the output from the foot controller.

B-2c Designation of Tone Strength

Bow Pressure/Bow Speed Control

Only the tone strength can be changed without any change of tone color, by changing the absolute values of bow pressure and bow speed while keeping the rate of bow pressure to bow speed constant. In this case, the respective values of the bow pressure and the bow speed can be adjusted by applying the output of the foot controller to "v" in the equation Eq2 while keeping the relation represented by the equation Eq3.

Output Gain Control

The structure is simplified by directly controlling the gain in the output portion. In this case, there is however a risk that the generated musical tone may become poor in variation, if the tone color changes according to the respective absolute values of the bow pressure and the bow speed though the ratio of the bow pressure to the bow speed is constant.

B-2d designation of Tone Quality

Case where the Rate of Bow Pressure to Bow Speed is changed

The tone color of the generated musical tone can be changed by changing "a" in the equation Eq3.

String Length Ratio Control

The tone quality can be changed by changing the ratio of the bridge-side string length to the nut-side string length. When, for example, the bridge- and nut-side string lengths are equal to each other, the string-rubbing position is just at the center of the string, physically. In this case, the string-rubbing point is in the loop portion of the first mode (fundamental tone) stationary wave corresponding to the string length, so that the fundamental tone component of string vibration is lost. When the string length ratio is 1:3, the string-rubbing point is in the loop portion of the second mode stationary wave of string vibration, so that the second mode component of string vibration is lost. As described above, spectral components of string vibration changes according to the string length ratio, so that this change is felt as the change of tone color.

The following equations Eq12 and Eq13 are deduced from the equations Eq7 and Eq8.

$$dly1 = LENG \times BPOS \quad \text{(Eq12)}$$

$$dly2 = LENG \times (1 - BPOS) \quad \text{(Eq13)}$$

In the equations Eq12 and Eq13, LENG represents the quantity determined by the pitch, and BPOS represents the quantity giving the string length ratio. The string lengths dly1 and dly2 are calculated on the basis of the equations Eq12 and Eq13, respectively.

In practical use, the CPU 5 carries out this calculation whenever an output from the foot controller is supplied, so that the tone color can be controlled by supplying the calculated value to the tone generator.

This process is based on the actual violin playing style. When, for example, a wide and powerful tone is to be generated in the violin, the performance style of approaching the string-rubbing point to the bridge to obtain large string length ratio is employed. This style can be also applied to the aforementioned process.

Bow Width Control

Figure 29:
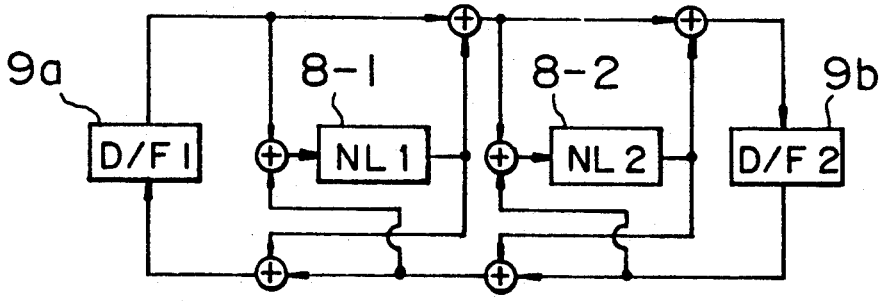
FIG. 29 is a block diagram showing an example of the configuration of a string-rubbing model using two bow hairs.

Although description has been made upon the rubbed string model using one bow, another rubbed string model using two or more bows can be provided by preparing a plurality of nonlinear portions for simulating the characteristics of friction between string and bow. FIG. 29 is a block diagram showing the structure of a rubbed string model using two bow hairs. The difference between FIGS. 29 and 4 is in that the model in FIG. 29 has two nonlinear portions 8-1 and 8-2.

In the aforementioned structure, the distance between the two bows is expressed by the number of stages in the shift register or by the difference between addresses in the memory, so that tone color can be changed by variably controlling the number of stages. In other words, this is nothing but bow width control. When the same bowing information is given to the nonlinear portions 8-1 and 8-2 in the aforementioned operation, bowing energy increases in accordance with the number of nonlinear portions.

Because the bow of the violin has many hairs, a tone more perfectly resembling the tone of the actual rubbed string instrument can be generated as the number of nonlinear portions increases. In practical use, it is difficult to provide a large number of nonlinear portions from the point of view of limitation on the memory or limitation in cost. Therefore, in this case, the number of stages in the shift register for bow width control may be modulated by random numbers. By this method, not only such an effect that the string is rubbed by many hairs can be provided when the frequency characteristic of the random numbers extends to a high frequency range, but tone color can be changed (swinging tone color can be provided) when the frequency characteristic of the random numbers is limited to a low frequency range.

Filter Control in the Output Portion

When the passing characteristic of a filter circuit in a loop in the linear portion in the tone generator 6 (see FIG. 4) is changed, the tone color of the synthesized tone can be changed. The change of the passing characteristic, however, has an influence on the tone generation frequency (pitch) and, accordingly, may stop tone generation. In the tone generator 6 shown in FIG. 4, however, the change of tone color without any change of the oscillation condition can be provided by controlling the filter characteristic (passing characteristic) of the output portion. When, for example, the filter circuit 11 is constituted by a linear digital filter, the cutoff frequency thereof can be controlled by changing one coefficient. If the coefficient is controlled by the output from the foot controller, tone color can be freely changed in the middle of a performance. This control can be applied to the case where two or more filters are used.

Filter Control in a Loop in the Linear Portion

Because changing the filter characteristic in a loop in the linear circuit is equivalent to changing the mass, tension and length of the string, tone color is also changed.

B-2e Special Performance Style

Harmonic mode selection in the flageolet performance style will be described hereunder. The frageolet performance style is a style in which a part of the vibrating string is slightly touched with a finger to use the touch point as a node of vibration to thereby change the tone generation spectra (harmonic arrangement) of the string. According to this style, the tone can be generated as a harmonic series corresponding to a fundamental tone determined by the string length.

Figure 30:
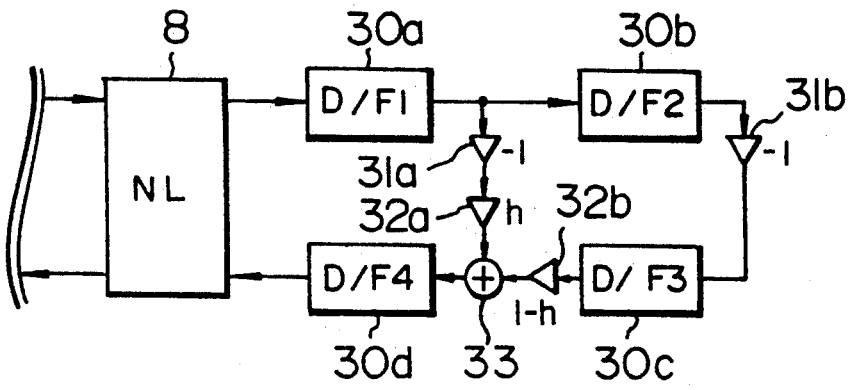
FIG. 30 is a block diagram showing an example of the configuration of the linear portion 9 in a model of flageolet performance.

FIG. 30 is a block diagram showing the structure of a linear portion for modeling the flageolet performance style. In the drawing, the reference numerals 30*a* to 30*d* designate concentrated constant circuits. Each of the concentrated constant circuits 30*a* to 30*d* comprises a delay circuit constituted by a shift register, a filter circuit, and a DC decay circuit. The concentrated constant circuits 30*a* to 30*d* use the characteristics of the respective circuits as concentrated constants. The reference numerals 31*a* and 31*b* designate inverters for simulating the fixed end reflection (phase inversion) of string vibration. The reference numerals 32*a* and 32*b* designate multipliers respectively having multiplication coefficients h and 1-h, and 33 designates an adder.

Figure 31:
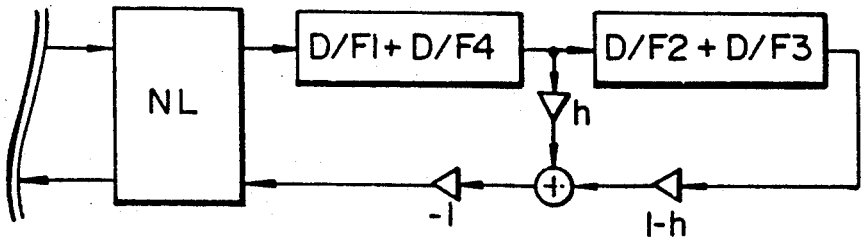
FIG. 31 is a block diagram showing another example of the configuration equivalent to the configuration shown in FIG. 30.

According to the aforementioned structure, a node of string vibration is formed by the concentrated constant circuit 30*a* and the inverter 31*a*. The harmonic structure of the string is changed by adding the output of the inverter 31*a* and the nut-side reflection wave in a predetermined rate, so that the flageolet performance style is modeled. The structure shown in FIG. 30 can be equivalently expressed as the structure shown in FIG. 31, in the point of view of the linearity of the circuit.

Figure 32:
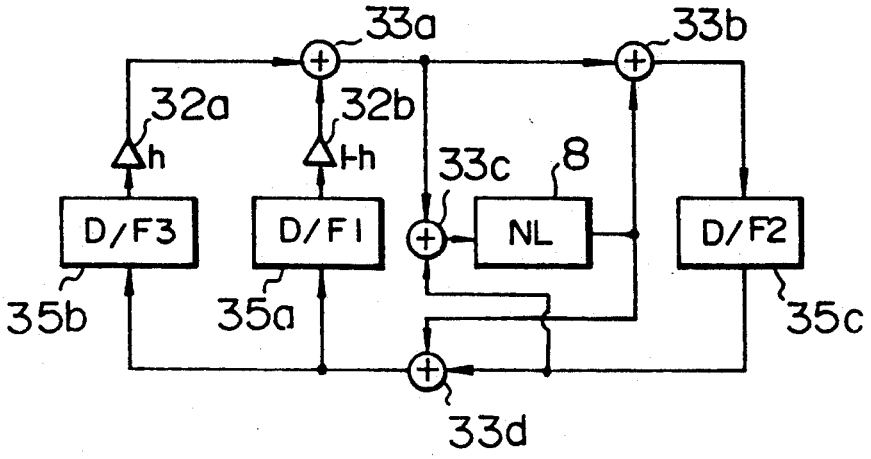
FIG. 32 is a block diagram showing an example of the configuration of a flegeolet string-rubbing model.

FIG. 32 is a block diagram showing the structure of a flageolet rubbed string model. In the drawing, the reference numerals 35*a* to 35*c* designate concentrated constant circuits. Each of the concentrated constant circuits 35*a* to 35*c* contains the characteristics of a delay circuit, a filter circuit and a DC decay circuit, and the characteristic of an inverter for simulating fixed end reflection. Let dly1, dly2 and dly3 be the delay quantities of the concentrated constant circuits 35*a* to 35*c*, respectively.

If, in the aforementioned structure, the multiplication coefficient h of the multiplier 32*a* is set to 0, the performance style provided is not a flageolet performance style but a general style. In this case, the values of dly1 and dly2 can be determined on the basis of the string length LENG and the string-rubbing point BPOS by the equations Eq12 and Eq13. When, in this condition, the value of the multiplication coefficient h is controlled in a range of $0<h<1$, a flageolet tone is generated. The degree of harmonics in the flageolet tone is determined in accordance with the set value of dly3. For example, to generate an n-degree harmonic flageolet tone, dly3 can be set by the following equation Eq14:

$$dly3=LENG/n-d3 \quad \text{(Eq14)}$$

in which d3 represents a value equivalent to the delay component of the filter circuit. The harmonic mode of flageolet in a performance can be changed by controlling the value of n through the output from the foot controller.

When such control is made through the foot controller, the pitch changes though the same key on a keyboard is depressed. Therefore, the string length LENG is obtained by executing the calculation as represented by the following equation Eq15:

$$LENG=fs/(fh/n)-(d1+d2) \quad \text{(Eq15)}$$

in which fh represents a desired tone generation frequency, fs represents a sampling frequency, and d1 and d2 respectively represent delay components of the concentrated constant circuits 35*a* and 35*b*. If dly3 is obtained from the equation Eq14 on the basis of the string length obtained from the equation Eq15, the harmonic mode can be controlled while the pitch of the generated tone is kept constant.

Rubbed String Model using Joy Stick

A joy stick is a manipulator which can deal with control quantity two-dimensionally. Vibrato control and bow pressure/bow speed control by means of a joy stick will be described hereunder.

Vibrato Control

Vibrato control is provide in accordance with the output from the joy stick in the same manner as in the control method using after-touch. In this case, vibrato depth and vibrato speed can be freely controlled in real time if the vibrato depth and the vibrato speed are determined so as to correspond to the two-dimensional displacement quantity of the joy stick.

Bow Pressure/Bow Speed Control

Because the bow pressure and the bow speed are controlled two-dimensionally, the control quantity thereof can be grasped visually, so that a performance rich in reproducibility can be provided.

B-4 Rubbed String Model using Foot Switch

When, for example, the foot switch is used as a sustain pedal of the piano, the foot switch serves as a switch for designating a damper-up state. A rubbed string model in which the foot switch manipulated by foot is applied to various performance styles will be described hereunder.

Tremolo Performance Style

The tremolo performance style is a style of rapidly reciprocating the bow to rapidly generate the tone of one key or rapid alternating the tones of two keys. In the case where, for example, the key assign of giving top priority to the last arrival in a monophonic mode is employed now, this performance style is provided by pushing down the foot switch to change the key assign to the key assign of giving top priority to the first arrival. The operation of the tremolo performance style will be described hereunder with reference to FIG. 33.

When a key depression signal is first supplied, the key depression data is written in the key buffer (a step SK1). Because there is now no data in the tone generation buffer, the key depression data is written in the tone generation buffer (steps SK2 and SK3). A key scale data corresponding to the key depression data is supplied to the tone generator 6 (a step SK4) to start the envelope generator to thereby start tone generation in accordance with bowing information (a step SK5).

When another new key is then depressed while the previous key is not released, "YES" is given as the result of the judgment in the step SK2 because the previous data is kept in the tone generation buffer. Accordingly, the envelope generator is restarted, so that a tone of the same pitch as that of the previous tone is generated.

When the key finally depressed is then released, the data of the key is erased from the key buffer (step SK6). Because the erased data is different from the data stored in the tone generation buffer, the result of the judgment in a step SK7 is "NO" and the envelope generator is re-started to generate a tone of the same pitch as that of the previous tone. The tremolo performance style as to tones of the same pitch is provided by repeating the aforementioned operation.

If no key is depressed when the first depressed key is released, "NO" is given as the result of the judgment in a step SK8 to thereby erase the data of the tone generation buffer, set the mode of the envelope generator to the release mode and stop tone generation after the passage of a predetermined time (steps SK8 and SK9). On the other hand, when another key is depressed, a tremolo operation can be carried out in the pitch of the key. When, for example, a plurality of keys are depressed, the priority thereof is evaluated in a step SK11. In respect to the priority evaluation, a rule of giving top priority to the last arrival is most easily adapted to the performance style.

On/Off of Portamento

The pitch of the generated tone can be changed if the data of string length is supplied to the tone generator 6. Further, the change of the pitch can be smoothened by using an interpolation circuit having a predetermined time constant at the time of the setting of string length. When the time constant is about 10 msec, the effect is not noticeable. When, on the contrary, the time constant is set to a value exceeding the order of hundreds of msec, the change of the pitch smoothened by a portamento effect can be provided.

Further, the interpolation circuit may be formed so that the time constant thereof can be classified into two, for example, one time constant of the order of tens of msec and the other constant of the order of hundreds of msec, and so that the time constant can be selected from the two. In this case, a portamento effect can be freely provided by operating the foot switch in a performance to select the time constant through the foot switch. Further, if the interpolation circuit is formed so the time constant is changed in accordance with the manipulation of the foot controller, the electronic musical instrument can be performed while the portamento effect is controlled.

On/Off of Slur

Figure 33:
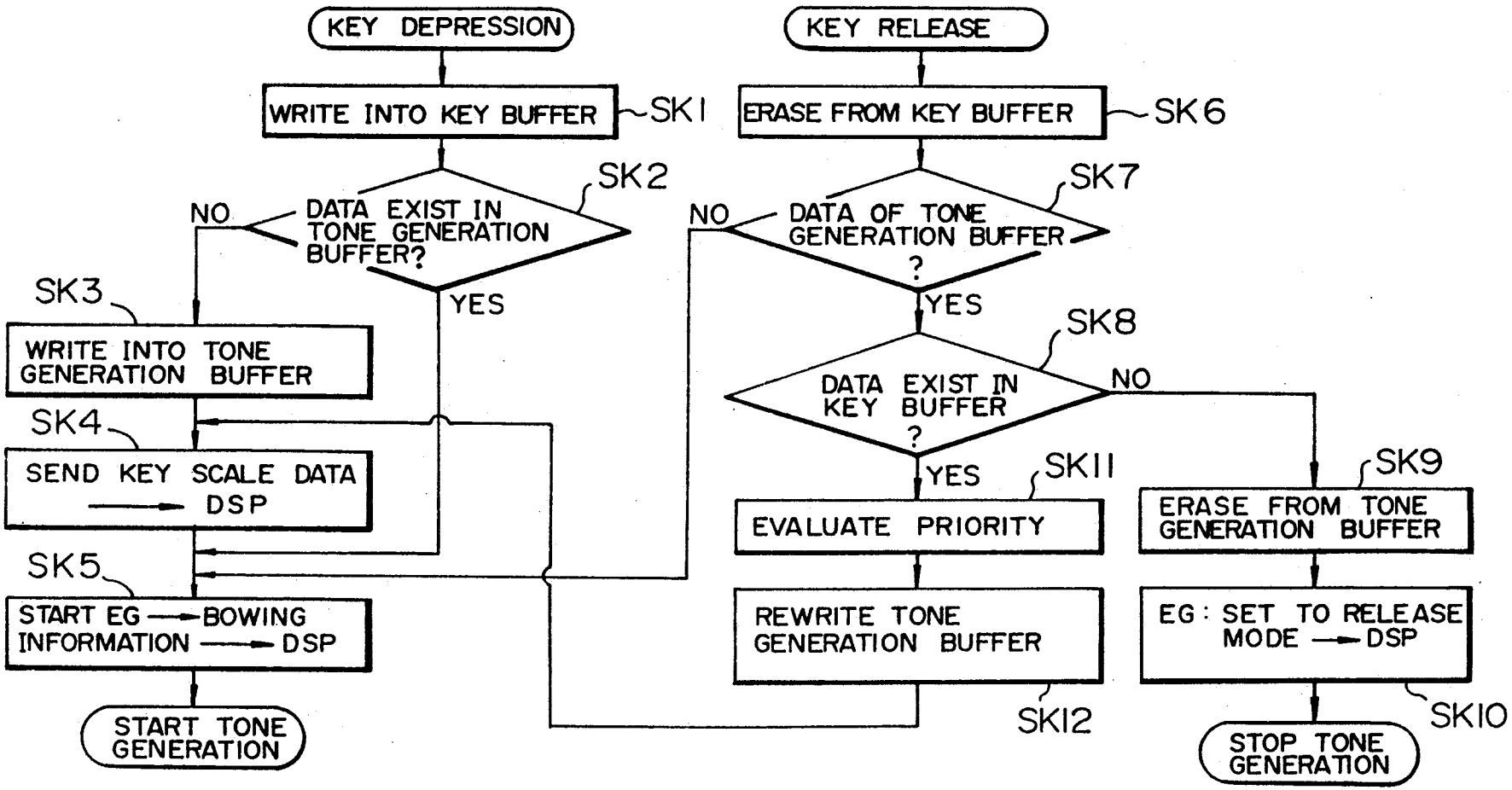
FIG. 33 is a flow chart for explaining the operation of tremolo performance.

If the operation of the envelope generator is disabled in the operation flow shown in FIG. 33, tone generation is made as the slur style different from bow returning. Accordingly, if the foot switch is arranged to switch over between the enabled state and the disabled state of the envelope generator as to whether the operation of the envelope generator is enabled or disabled, a suitable performance style can be selected between the slur performance style and the bow returning performance style.

On/Off of Pizzicato

Figure 34:
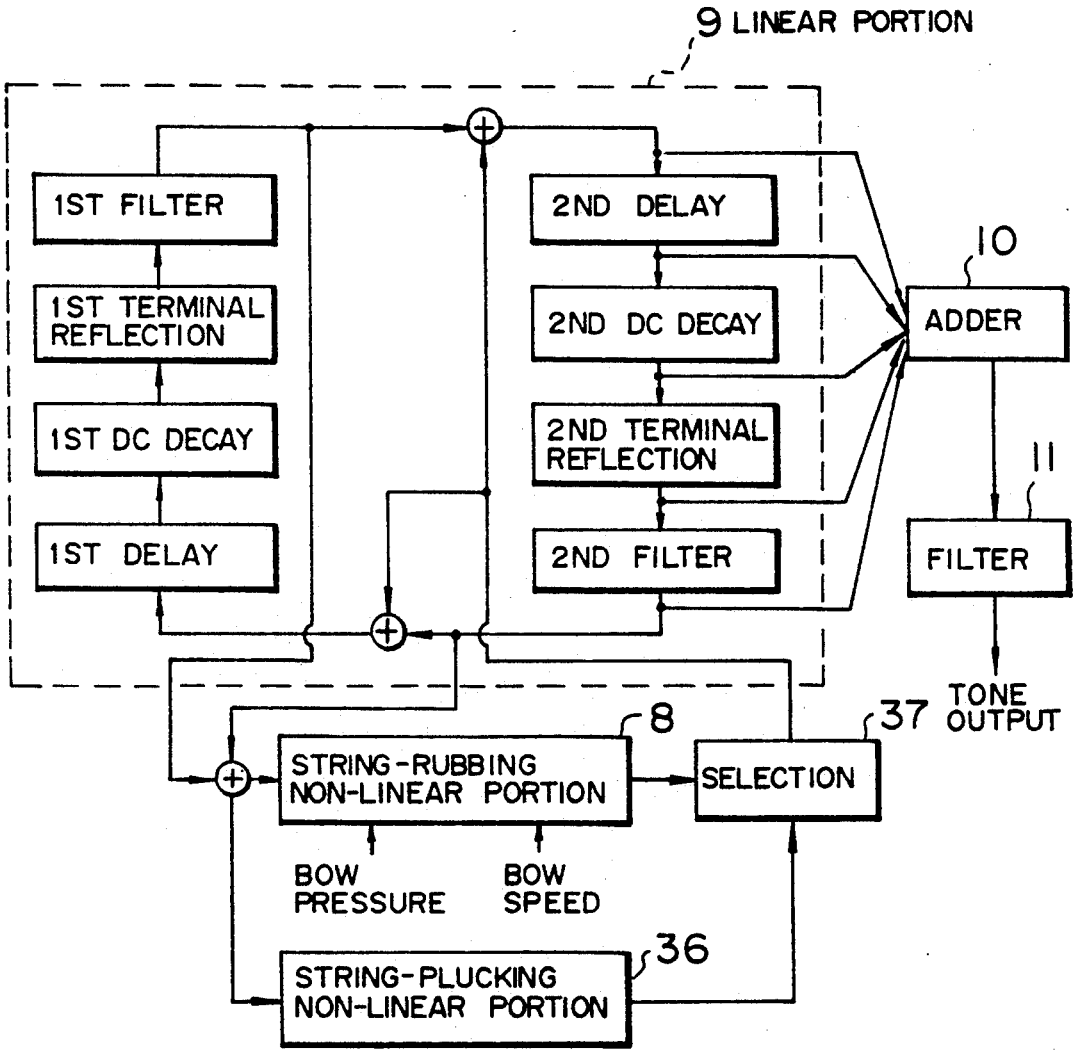
FIG. 34 is a block diagram showing an example of the configuration of the tone generator for attaining pizzicato performance.

Pizzicato is a performance style of plucking a string with a finger instead of rubbing a string with a bow. FIG. 34 is a block diagram showing the structure of a tone generator for providing the pizzicato performance style. The difference between the tone generator in FIG. 34 and the tone generator in FIG. 4 is in that the tone generator in FIG. 34 includes a string-plucking nonlinear portion 36 connected in parallel to the nonlinear portion 8, and a selection circuit 37 for switching between the output of the nonlinear portion 36 and the output of the nonlinear portion 8.

According to this structure, when a string-rubbing operation is carried out in the condition that the vibration of a string rubbed with a bow is simulated by the string-plucking nonlinear portion 36, a string wave having such a sharp rising-up curve that cannot be obtained by the string-rubbing operation is generated. By this method, tones having a pizzicato effect can be generated.

On/Off of Col Legno

Col legno is a performance style of rubbing a string with a wood portion of a bow. The difference between this case and the case of rubbing a string with bow hairs is in a difference in friction characteristic. Accordingly, the col legno performance style can be provided by replacing the function expressing friction characteristic by the friction characteristic between wood and string. When two types of friction characteristics between bow and string and between wood and string are prepared in advance so that one type can be selected from the two types in accordance with the output of the foot switch, the style can be switched over between the general style and the col legno style.

Unison on Different Strings

In respect to the violin and the like, the tone of the same pitch can be generated from different strings, so that the tone of the same pitch can be generated in slur. In the case of "Bach: Unaccompanied cello suit, No. 6 prelude", D tones having a slur effect can be generated by alternatively playing the second and third strings of the cello.

This performance style can be provided by using the foot switch. When the key of the same pitch as that of the currently generated tone is depressed in the condition that the foot switch is pushed down, another tone generator is assigned for the key so that the tone of the same pitch can be generated every time. On the other hand, in the case where the switch is released, the same operation as in the performance style on different strings shown in FIG. 19 can be provided.

For example, to generate D tones in a slur effect in "Bach: Unaccompanied cello suit, No. 6 prelude", first the "D" key is depressed and then the foot switch is pushed down to form a sustaining D tone. Then, the "D" key is released and then the same key is depressed. As a result, tones down to the second note are generated. Then, the foot switch is released to cancel the sustaining state. Then, the "D" key is released and then depressed again. Then, the key is released in the condition that the foot key is not pushed down. As a result, tones down to the third note are generated. Thereafter, the same manipulation as described above is repeated in accordance with the performance.

B-5 Rubbed String Model using Slide Volume

Bow Speed Control

Figure 35:
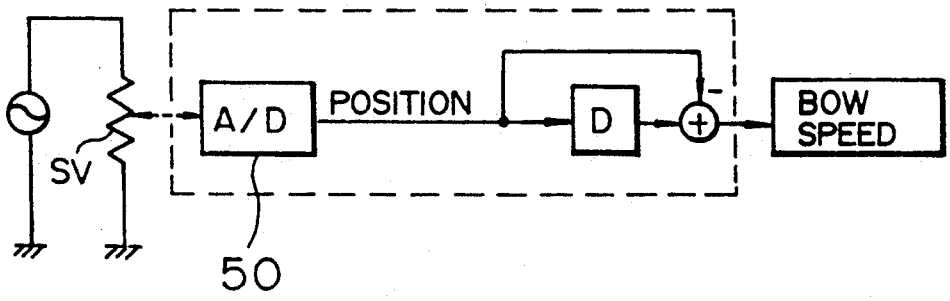
FIG. 35 is a block diagram showing an example of the configuration in the case where bow velocity is controlled by a slide volume SV.

If a slide variable resistor is arranged so as to be movable horizontally, the slide variable resistor can be manipulated with the same feeling as in the actual bowing operation. Specifically, as shown in FIG. 35, the output voltage produced in accordance with the position of the slide variable resistor SV is subjected to A/D conversion to provide the digital quantity as bow position information. Further, suitable scaling is applied to this bowing information to obtain a bow pressure data to be supplied to the tone generator. To manipulate the slide variable resistor SV with the same feeling as in the actual bowing operation of the violin, the length of the movable range thereof is preferably set in a range of about 40 to about 80 cm.

Bow Pressure Control

If the slide variable resistor SV is arranged so as to be movable vertically, the manipulation thereof is suitable for controlling bow pressure. If there is provided such a structure in which the slide variable resistor is automatically returned when it is moved down, the manipulation thereof can be improved more greatly.

B-6 Rubbed String Model using Portamento Bar

String Length Control

Figure 36:
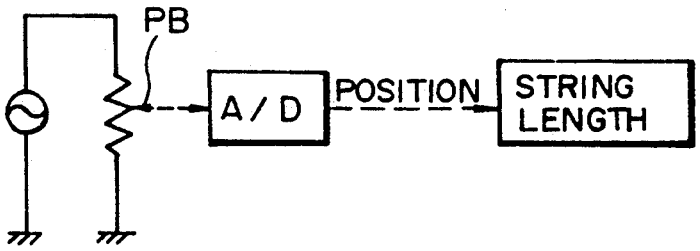
FIG. 36 is a block diagram showing an example of the configuration in the case where string length control is provided by a portamento bar PB.

The portamento bar has a structure in which the resistance value changes in accordance with the position of pressure given by a finger. FIG. 36 is a block diagram showing the structure of string length control using the portamento bar PB. According to this structure, a signal corresponding to the position of pressure given by a finger is generated, so that string length is controlled on the basis of the signal. In this control, the string length can be determined arbitrarily, so that not only vibrato control and portamento control can be provided but the tone of the pitch tuned freely regardless of the temperament can be generated, in accordance with the control means. Further, the portamento bar PB exhibits a constant resistance value when the finger giving pressure is released. Accordingly, a pitch control manipulator having the concept "open string" can be formed easily.

Tone Quality Control

Free bow speed data can be generated by controlling bow speed data through the slide variable resistor SV, so that tone quality can be changed freely. Further, not only the string-rubbing point can be controlled by the slide variable resistor but the bow width can be controlled by the slide variable resistor.

B-7 Rubbed String Model using Pressure Sensor

When, for example, a pressure sensor is attached to a knob of the slide variable resistor SV, bow pressure information corresponding to the pressure of a finger operating the volume can be generated. Such a pressure sensor may be arranged in a lower surface of a slide variable resistor or a joy stick so that the pressure given in manipulation of the variable resistor can be detected as the bow pressure.

C. Other Embodiments

C-1 Resonance System

Figure 37:
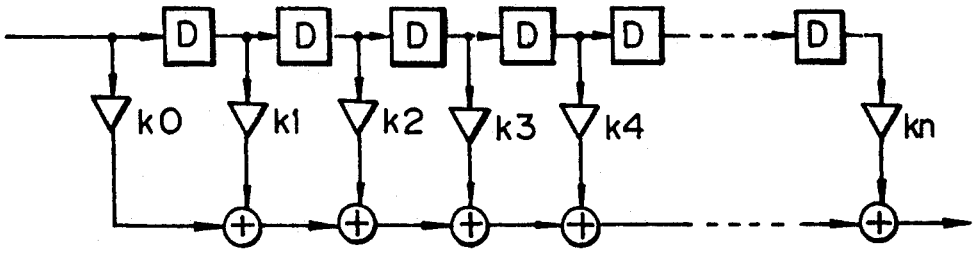
FIG. 37 is a block diagram showing an example of the configuration of the FIR filter on which resonance of a body of a rubbed string instrument is modeled.

An FIR filter for modeling the resonance in a body of a rubbed string instrument is shown in FIG. 37. According to this structure, a desired resonance characteristic can be obtained by suitably giving decay coefficients K0 to Kn respectively to the delays D. The desired resonance characteristic is obtained by approximating an impulse response characteristic obtained when the bridge of the actual violin is vibrated. The resonance system using the FIR filter is considered to be a process of calculating the impulse response by convolution. In this structure, a higher accurate resonance characteristic can be provided as the sampling frequency becomes higher or as the number of stages in the filter becomes larger.

Figure 38:
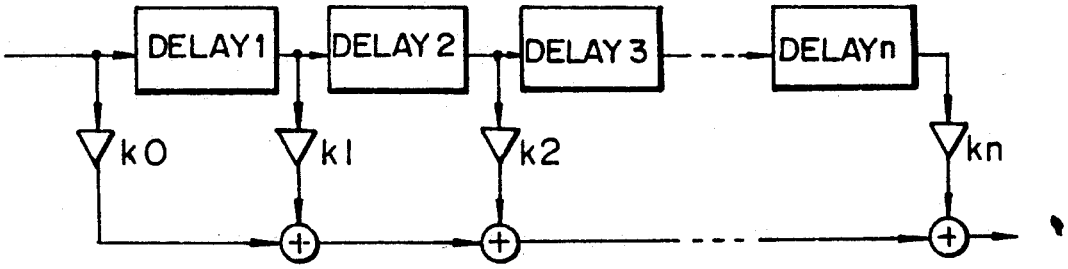
FIG. 38 is a block diagram showing an example of the configuration of the FIR filter on which resonance of a body of a rubbed string instrument is modeled.

In the point of view of the resonance characteristic of the actual musical instrument, the structure shown in FIG. 37 is not always required of the FIR filter. For example, a sufficient characteristic can be provided by combining multi-delay elements (delay1 to delayn) as shown in FIG. 38. According to this structure, not only the number of arithmetic operation elements can be reduced to make the hardware configuration easy, but the number of parameters controlling the resonance characteristic can be reduced to make the control easy.

A more complex resonance characteristic can be simulated also by using an IIR filter or an all-pass filter. Particularly in the structure using the all-pass filter, an inharmonious resonance characteristic can be provided whereby a characteristic corresponding to the quality of the resonance body can be simulated.

C-2 Rubbed String Model on Consideration of Transverse Wave and Longitudinal Wave In the rubbed string model as described above, the string vibration wave is modeled on the basis of the following equation Eq16 under the consideration of the transverse wave given by the bow send.

$$\sigma \frac{\partial^2 u}{\partial t^2} = \frac{\partial^2 u}{\partial x^2} \qquad \text{(Eq 16)}$$

This equation Eq16 is valid when external force does not act. In the equation, $\sigma$ represents the linear density of the string, T represents the tension of the string, t represents time, x represents a displacement in the direction of the length of the string, and u represents a displacement in the direction perpendicular to x. This equation is valid when the displacement u is taken in the direction of bow speed, and this equation is also valid when the displacement u is taken in the direction of bow pressure. According to the equation, vibration caused by the displacement in the direction of bow speed and vibration caused by the displacement in the direction of bow pressure exhibit perfectly independent behaviors.

Accordingly, when displacement is given only to the direction of bow pressure by bowing, string vibration is produced in this direction but string vibration is not produced in the direction of bow pressure. Strictly speaking, the displacement caused by the bow pressure must be given to the direction of the bow pressure but the bow pressure acts as external force with respect to vibration in the direction of the bow pressure to suppress the vibration. As described above, according to the equation Eq16, transverse-wave vibration only in the direction of bow speed is produced by bowing.

Figure 39:
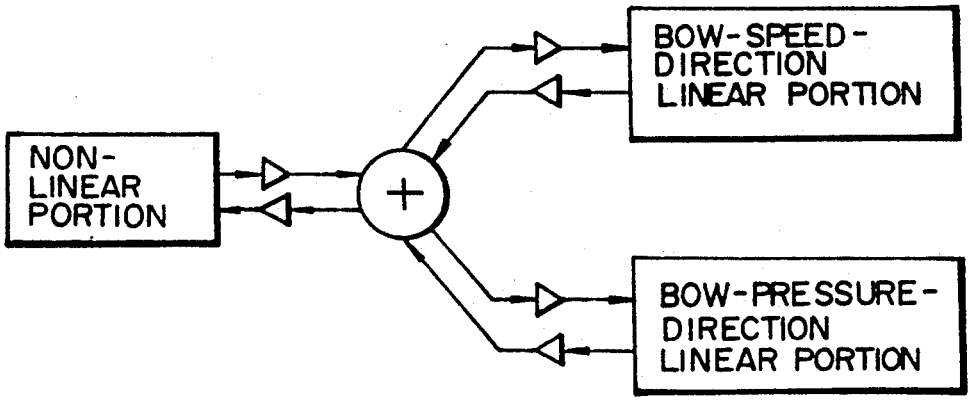
FIG. 39 is a block diagram showing an example of the configuration of a string-rubbing model under the consideration of transverse wave and longitudinal wave.

Because the equation Eq16 is valid under the condition that tension T is constant, the tension T changes when a large displacement is given by bowing. Accordingly, the relation expressed by the equation Eq16 becomes divergent so that string vibration is produced also in the direction of the bow pressure. Such a relation can be expressed through linear approximation by the following equation Eq17:

$$V=\epsilon\times u \qquad \text{(Eq17)}$$

in which u represents a displacement of the string in the direction of the bow speed. V represents a displacement of the string in the direction of the bow pressure, $\epsilon$ represents a coefficient for relating the displacements u and V in accordance with the change of tension T. Such linear approximation can be provided by a rubbed string model shown in FIG. 39. That is, the nonlinear portion expressing a friction characteristic between bow and string at the string-rubbing point generates a displacement of the string in the direction of the bow speed and, at the same time, generates a displacement of the string in the direction of the bow pressure in accordance with the tension T. Then, these are supplied respectively to the bow-speed-direction linear portion for simulating the propagation characteristic of the transverse wave in the direction of bow speed and to the bow-pressure-direction linear portion for simulating the propagation characteristic of the transverse wave in the direction of the bow pressure. As a result, a more faithful rubbed string model is provided.

C-3 Sympathetic String

In a rubbed string instrument such as a violin, a plurality of strings are stretched. Each of strings free from rubbing is resonated in the frequency of an open string if the string is not pressed by finger. On the other hand, each of strings pressed by finger is resonated in a frequency corresponding to the length thereof, inclusive of harmonics. The resonance phenomenon brings something of the rubbed string instrument, different from the resonance characteristic of the body. The characteristic of sympathetic strings can be provided by the rubbed string model shown in FIG. 39.

C-4 Controlling of Envelope Generator according to the Relation between Environments before and after Key Event Although above description has been made upon the case where the envelope generator is controlled for tone generation whenever a key depression process is carried out, the present invention can be applied to the case where the envelope generator may be controlled in accordance with the relation between environments before and after a key event. For example, there can be provided such control in which the previous tone is released rapidly when the current key is depressed in a large initial touch, and such control in which the attack portion is rapidly formed with respect to the key depressed after a short key depression gate period. That is, control can be made while the flow of phrases in a musical program is considered.

While preferred embodiments of the present invention have been described using specific terms, such description is for illustrative purposes only, and it is to be understood that changes and variations may be made without departing from the spirit of the scope of the following claims.

What is claimed is:

1. A musical tone signal synthesizing apparatus for an electronic musical instrument, comprising:
   - a manipulator for generating performance information corresponding to manipulation thereof;
   - envelope signal generating means for converting the performance information into an envelope signal, a value of which changes over time;
   - excitation means for generating an excitation signal on the basis of the envelope signal; and
   - a loop circuit for circulating the excitation signal inputted from the excitation means, the loop circuit having delay means which delays a signal circulating in the loop by a delay time corresponding to a tone pitch of a musical tone signal to be generated,
   - wherein the musical tone signal is extracted from at least one of the loop circuit and the excitation means.

2. An electronic musical instrument according to claim 1, wherein said excitation means generates said excitation signal on the basis of a function expressing the characteristic of friction between a bow and the string at a string-rubbing point.

3. An electronic musical instrument according to claim 1, wherein said loop circuit includes a delay circuit for expressing the propagation delay of vibration, a filter circuit for expressing the passing characteristic and the phase characteristic of said vibration, and a reflection coefficient circuit for expressing phase inversion at a fixed end.

4. An electronic musical instrument according to claim 3, wherein said tone generator circuit includes an adder circuit connected to a plurality of connection points of said loop circuit so as to add signals obtained at said connection points.

5. An electronic musical instrument according to claim 4, wherein said tone generator circuit further includes an output filter circuit connected to an output of said adder circuit.

6. An electronic musical instrument according to claim 3, wherein said loop circuit further includes a decay circuit.

7. An electronic musical instrument according to claim 3, wherein said tone generator circuit includes an adder circuit connected to a plurality of connection points of said loop circuit so as to add signals obtained at said connection points.

8. An electronic musical instrument according to claim 7, wherein said tone generator circuit further includes an output filter circuit connected to an output of said adder circuit.

9. An electronic musical instrument according to claim 1, wherein said excitation means includes an adder for adding, to each other, a signal received from said loop circuit and a signal corresponding to a bow velocity and being received from said parameter generating means, and a circuit for modulating an output of said adder on the basis of a nonlinear function having a value which changes according to a signal corresponding to a bow pressure and being received from said parameter generating means.

10. An electronic musical instrument according to claim 9, wherein an output of said modulating circuit is connected to two points of said loop circuit.

11. An electric musical instrument according to claim 10, wherein said loop circuit is divided into two portions by two points connected to said excitation means, said two portions having equivalent constituents.

12. An electronic musical instrument according to claim 11, wherein each of said two portions includes a decay, a phase inverter, a filter, and a delay.

13. An electronic musical instrument according to claim 12, wherein the delays of said two portions provide different delay periods, the sum of which mainly determine the pitch of a musical tone to be generated.

14. An electronic musical instrument according to claim 12, wherein one of the delays of said two portions provides a delay period being variable according to a pitch signal obtained from said parameter generating means.

15. An electronic musical instrument according to claim 14, wherein said tone generator circuit includes an adder circuit connected to a plurality of connection points of said loop circuit so as to add signals obtained at said connection points.

16. An electronic musical instrument according to claim 15, wherein said tone generator circuit further includes an output filter circuit connected to an output of said adder circuit.

17. An electronic musical instrument according to claim 16, further comprising a resonance circuit which receives an output of said output filter circuit to thereby provide a characteristic simulating resonance of a body of a natural musical instrument.

18. An electronic musical instrument according to claim 1, further comprising a plurality of loop circuits, and a selector.

19. An electronic musical instrument according to claim 1, wherein said excitation means has a plurality of nonlinear circuits.

20. An electronic musical instrument according to claim 1, wherein said loop circuit has at least one short-circuit path.

21. An electronic musical instrument according to claim 1, wherein said excitation means has a plurality of nonlinear circuits and a selector for selecting one of the plurality of nonlinear circuits.

22. An electronic musical instrument according to claim 1, wherein said excitation means has a nonlinear circuit which includes a static friction function circuit storing data of a static friction function and a dynamic friction function circuit storing data of a dynamic friction function.

23. An electronic musical instrument according to claim 1, wherein the manipulator comprises a plurality of keys each of which generates key information data as performance information, and the parameter generating means comprises an envelope generator circuit which generates an envelope based on the key information data so as to use values of the envelope as the tone generation parameters.

24. A musical tone signal synthesizing apparatus according to claim 1, wherein the manipulator has a plurality of keys, each of which generates a key-on signal, a key-code signal and a key-touch signal as the performance information.

25. A musical tone signal synthesizing apparatus according to claim 24, wherein the envelope signal is generated based on the key-on signal and the key-touch signal, and the tone pitch is determined based on the key-code signal.

26. A musical tone signal synthesizing apparatus for an electronic musical instrument, comprising:

a manipulator for generating performance information corresponding to manipulation during a performance by a player;

excitation means for generating an excitation signal on the basis of the performance information;

at least two loop circuits for circulating the excitation signal inputted from the excitation means, each of the loop circuits having delay means which delays a signal circulating in the loop by a delay time corresponding to a tone pitch of a musical tone signal to be generated; and controlling means for assigning one of the two loop circuits based on the performance information and for supplying the excitation signal generated by the excitation means to the assigned loop circuit, wherein the musical tone signal is extracted from at least one of the two loop circuits.

27. A musical tone signal synthesizing apparatus according to claim 26, wherein the manipulator has a plurality of keys, and, when each of the plurality of keys is depressed, a key-on signal, a key-code signal and a key-touch signal are generated as performance information corresponding to the depressed key.

28.. A musical tone signal synthesizing apparatus according to claim 27, wherein the excitation signal is generated based on the key-on signal and the key-touch signal, and the tone pitch is determined based on the key-code signal.

29. A musical tone signal synthesizing apparatus according to claim 27, wherein when a key is newly depressed, one of the two loop circuits which was not assigned in the immediately previous key depression is assigned for newly depressed key.

* * * * *